US012454831B2

(12) United States Patent
Herzl

(10) Patent No.: US 12,454,831 B2
(45) Date of Patent: Oct. 28, 2025

(54) FOLDING STAIR WITH TREAD OVERHANG

(71) Applicant: Matthew Yeatman Herzl, Marshall, AR (US)

(72) Inventor: Matthew Yeatman Herzl, Marshall, AR (US)

( * ) Notice: Subject to any disclaimer, the term of this patent is extended or adjusted under 35 U.S.C. 154(b) by 301 days.

(21) Appl. No.: 18/302,619

(22) Filed: Apr. 18, 2023

(65) Prior Publication Data

US 2023/0392383 A1 Dec. 7, 2023

Related U.S. Application Data

(60) Provisional application No. 63/332,908, filed on Apr. 20, 2022.

(51) Int. Cl.

| | |
|---|---|
| ***E04F 11/06*** | (2006.01) |
| ***E04F 11/022*** | (2006.01) |
| ***E04F 11/025*** | (2006.01) |
| *E04F 11/032* | (2006.01) |

(52) U.S. Cl.

CPC ..... *E04F 11/064* (2013.01); *E04F 11/0223* (2013.01); *E04F 11/025* (2013.01); *E04F 11/032* (2013.01)

(58) Field of Classification Search

CPC ... E06C 1/16; E06C 1/36; E06C 1/381; E06C 1/383; E06C 1/382; E06C 1/39; E06C 1/393; E06C 1/3835; E06C 1/386; E06C 9/06; E06C 9/085; E06C 9/12; E04F 11/064; E04F 11/04; E04F 11/06; E04F 11/062; E04F 11/0223; E04F 11/025; E04F 2011/005; E04F 2011/0201; E04F 2011/0203

See application file for complete search history.

(56) References Cited

U.S. PATENT DOCUMENTS

| | | | | |
|---|---|---|---|---|
| 34,314 A | | 2/1862 | Monson | |
| 193,081 A | * | 7/1877 | Gay | |
| 2,875,935 A | * | 3/1959 | Buttermore | E06C 1/383 182/160 |
| 5,157,151 A | * | 10/1992 | Angres | C07C 211/38 562/466 |
| 5,722,507 A | * | 3/1998 | Kain | E06C 1/393 182/104 |
| 5,967,260 A | * | 10/1999 | Spak | E06C 1/393 182/228.3 |
| 6,457,559 B1 | * | 10/2002 | Schlueter | E06C 1/383 182/159 |

(Continued)

*Primary Examiner* — Jessica L Laux

(57) ABSTRACT

An improved folding stair comprising a sequence of steps (101), each rotably mounted to a structure (102) via axes (103) located and oriented to facilitate rotation between deployed and stowed states, such that the steps exhibit tread overhang (109) in their deployed state. The step width (105) exceeds the step rise (107). In other embodiments the axes are to one side of the steps. In other embodiments the angle of rotation between deployed and stowed states exceeds the arccosine of step-above thickness (104) over step rise. In other embodiments the movement from deployed to stowed state moves the steps from the traversal path. In other embodiments the axes are either skew to the deployed tread, or to the traversal path, or to both. Other embodiments include a means of coordinating the steps' folding motion.

18 Claims, 44 Drawing Sheets

(56) References Cited

U.S. PATENT DOCUMENTS

| | | | | |
|---|---|---|---|---|
| 6,536,558 | B2 * | 3/2003 | Price | E06C 1/383 182/162 |
| 6,619,427 | B1 * | 9/2003 | Kerr | A47B 96/00 182/39 |
| 6,802,393 | B2 * | 10/2004 | Zheng | E06C 1/32 182/159 |
| 10,849,434 | B1 * | 12/2020 | Gonzalez | A47C 19/20 |
| 10,889,993 | B2 * | 1/2021 | Bianchi | E04F 11/062 |
| 11,203,872 | B2 * | 12/2021 | Hilgendorf | E04F 11/062 |
| 2013/0037350 | A1 * | 2/2013 | Geiselman, III | E06C 7/16 182/159 |
| 2020/0102788 | A1 | 4/2020 | Byers | |

* cited by examiner

Figure 1: Prior Art

Figure 2: Prior Art

Figure 3: Prior Art

Figure 4
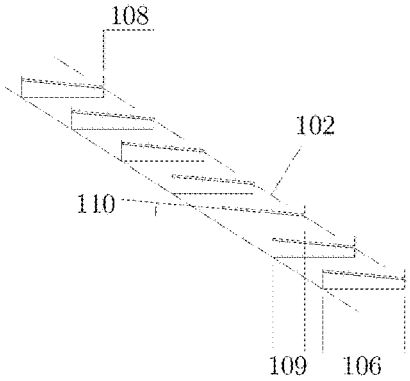
Fig. 4A
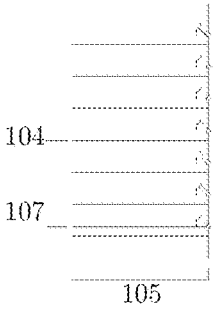
Fig. 4B
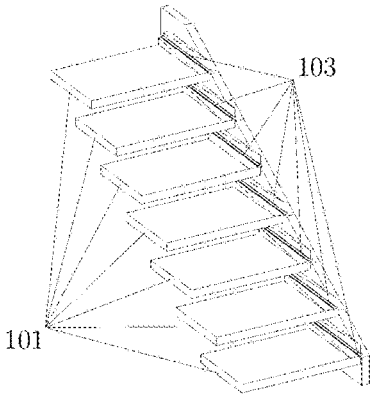
Fig. 4C
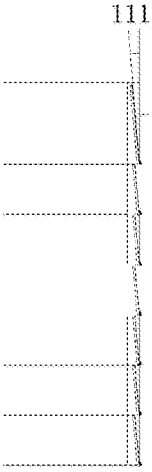
Fig. 4D
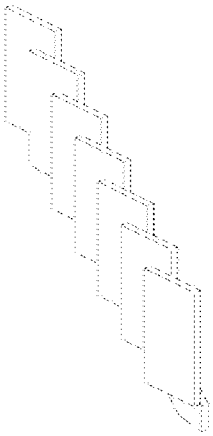
Fig. 4E
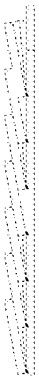
Fig. 4F Figure 5
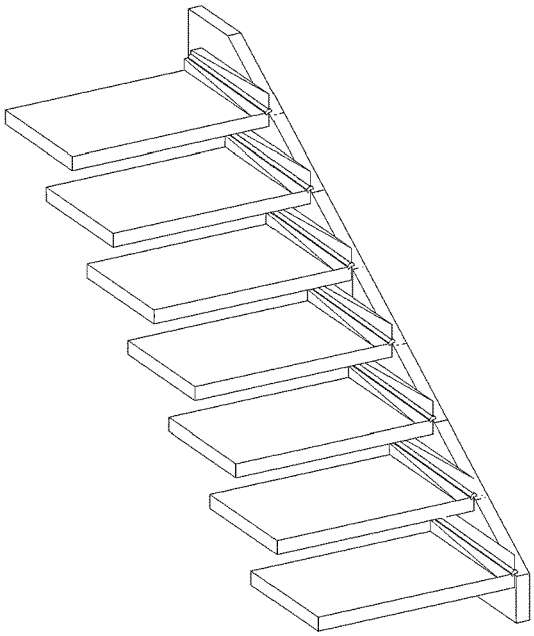
Fig. 5A
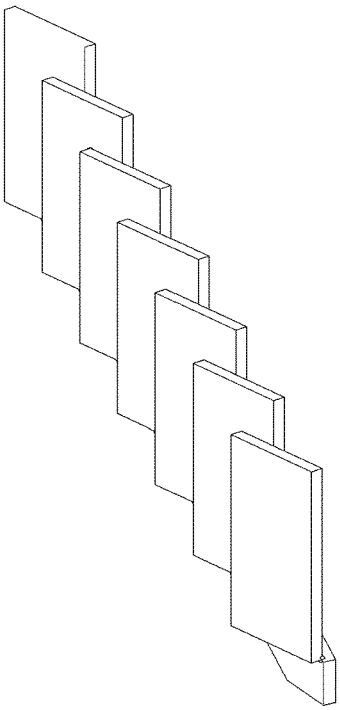
Fig. 5B Figure 6
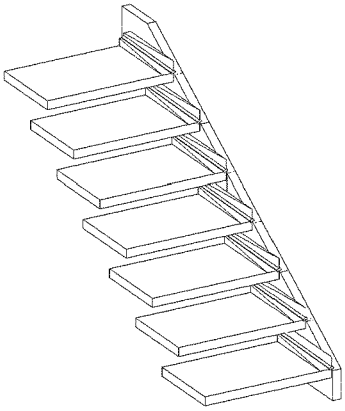
Fig. 6A
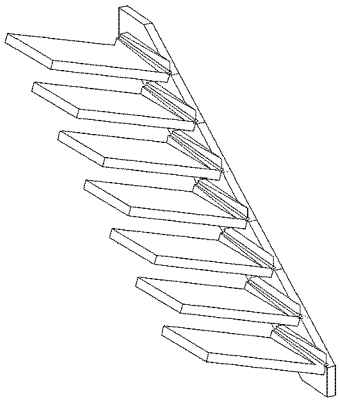
Fig. 6B
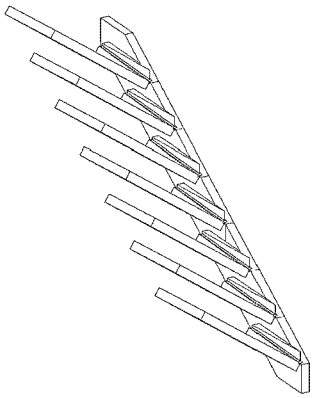
Fig. 6C
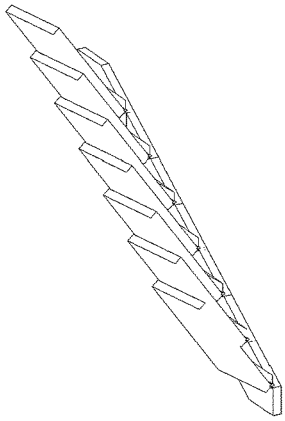
Fig. 6D
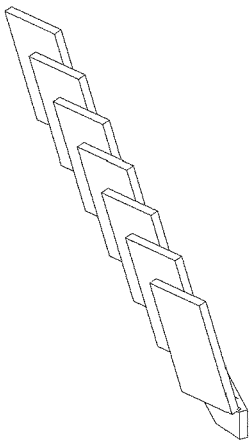
Fig. 6E
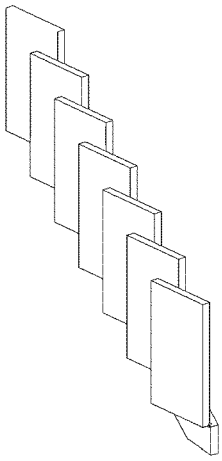
Fig. 6F Figure 7
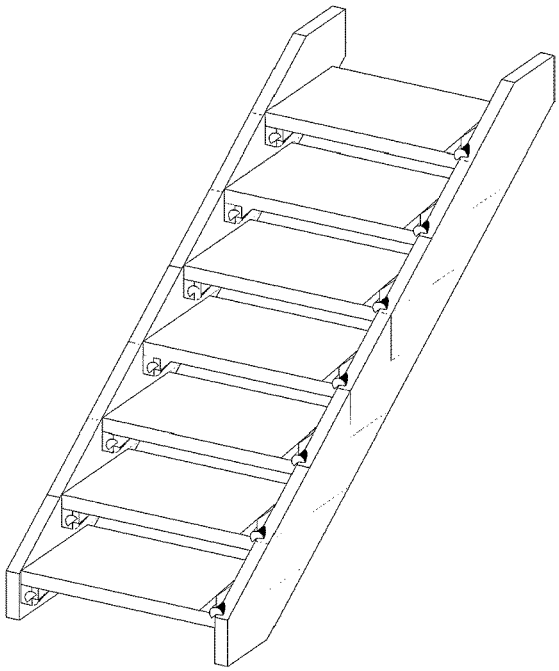
Fig. 7A
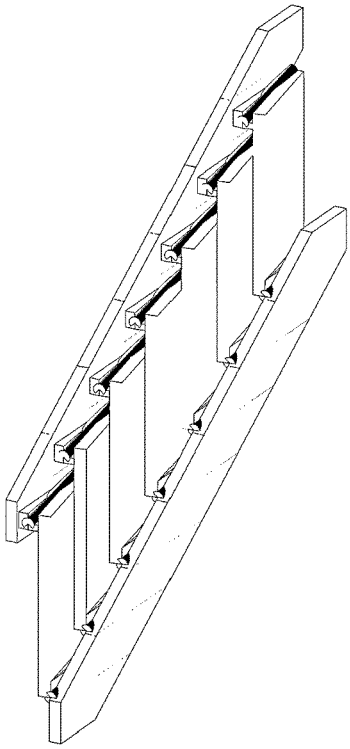
Fig. 7B Figure 8
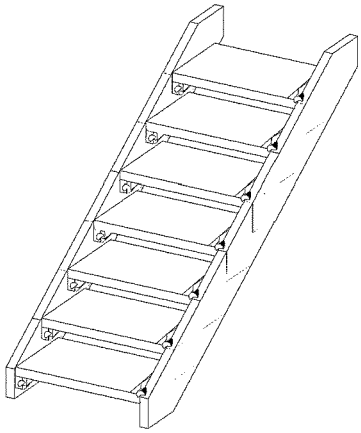
Fig. 8A
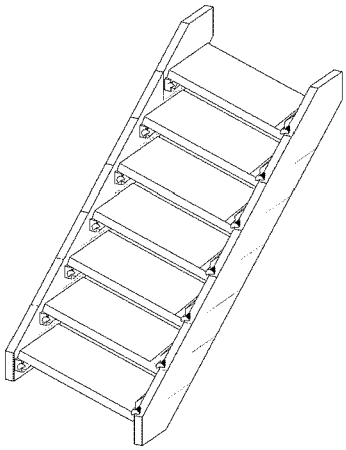
Fig. 8B
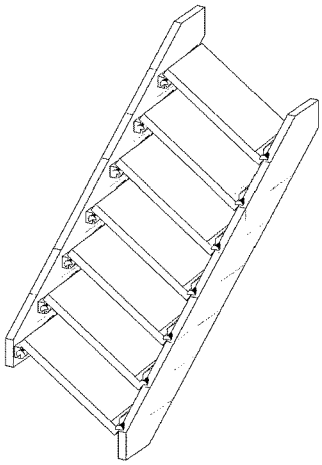
Fig. 8C
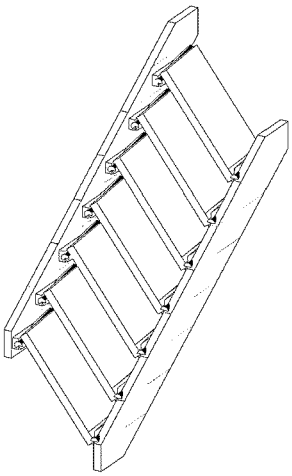
Fig. 8D
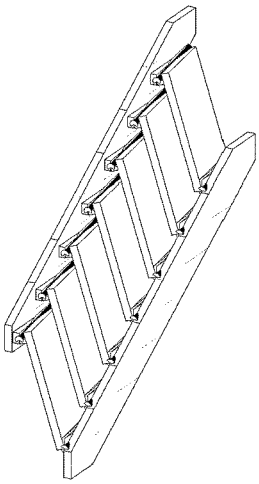
Fig. 8E
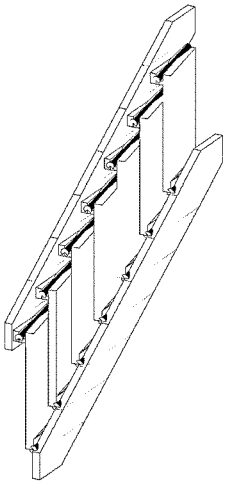
Fig. 8F Figure 9
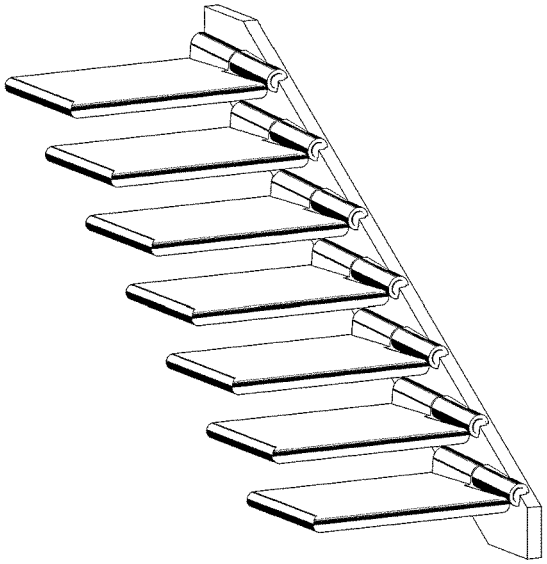
Fig. 9A
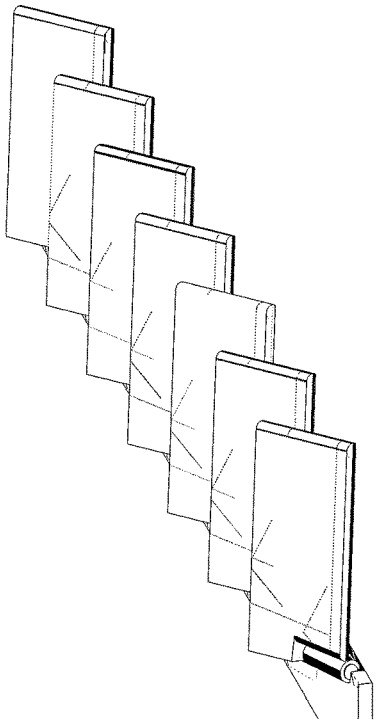
Fig. 9B Figure 10
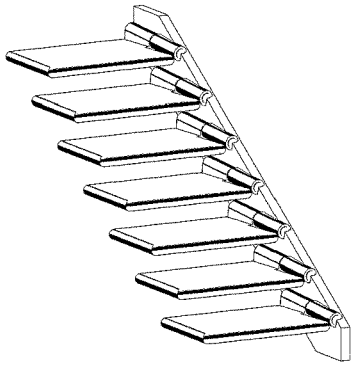
Fig. 10A
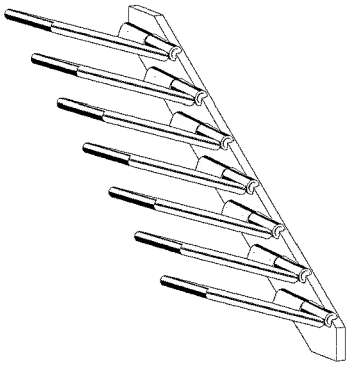
Fig. 10B
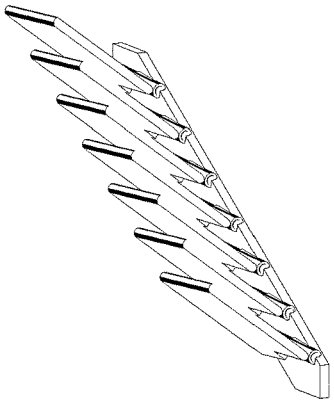
Fig. 10C
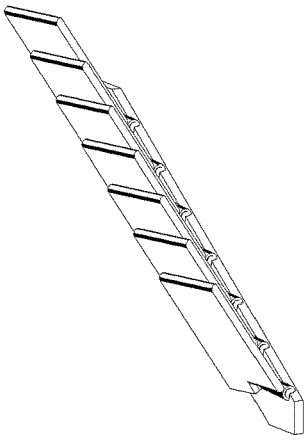
Fig. 10D
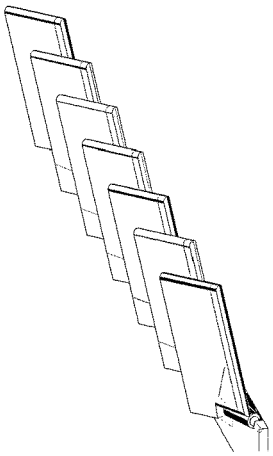
Fig. 10E
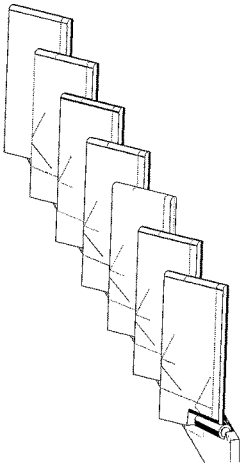
Fig. 10F Figure 11
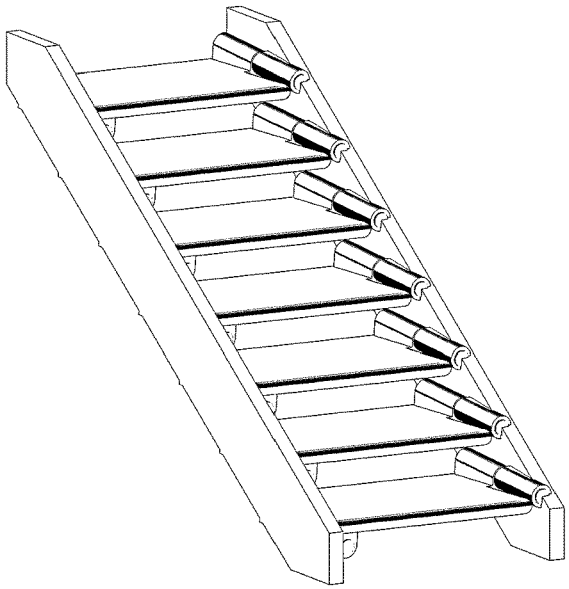
Fig. 11A
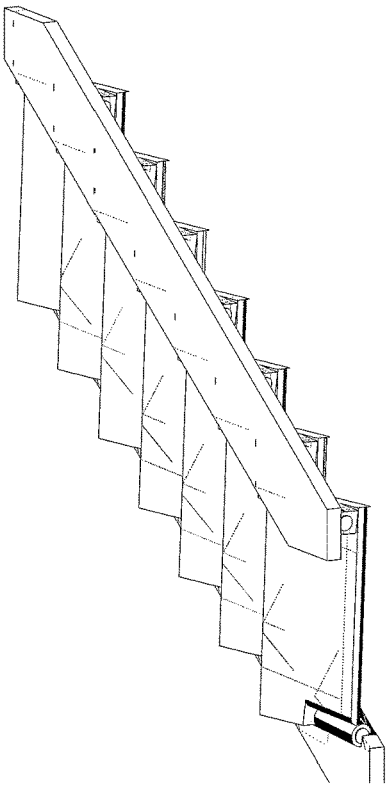
Fig. 11B Figure 12
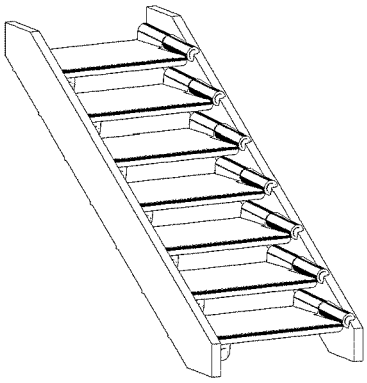
Fig. 12A
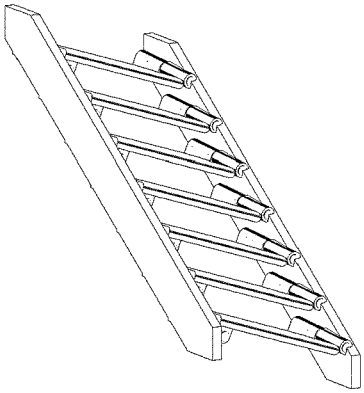
Fig. 12B
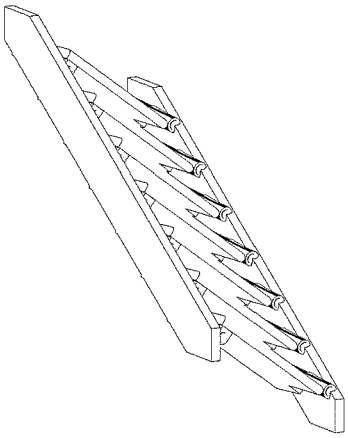
Fig. 12C
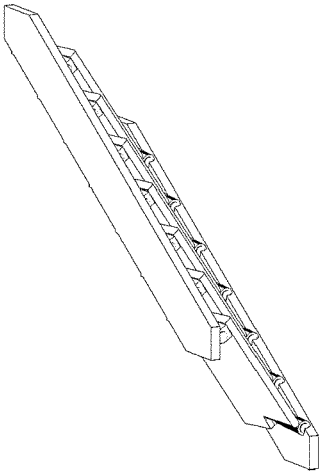
Fig. 12D
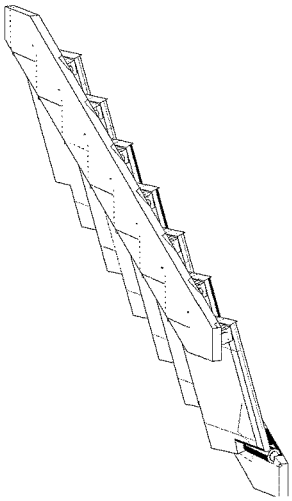
Fig. 12E
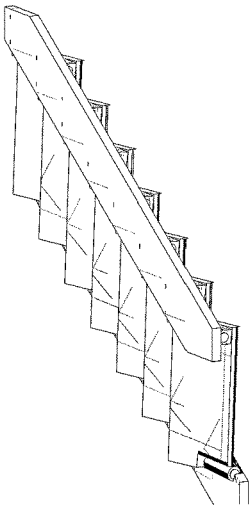
Fig. 12F Figure 13
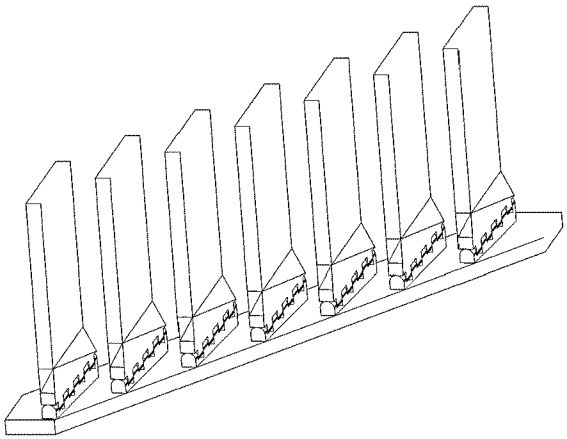
Fig. 13A
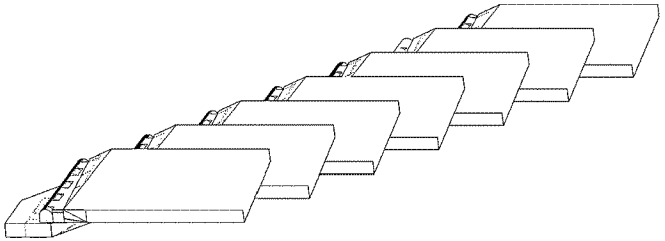
Fig. 13B Figure 14
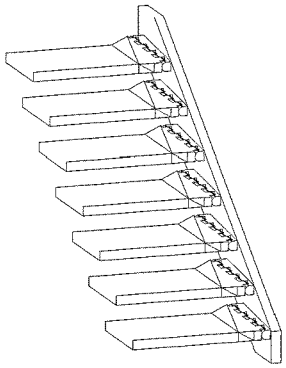
Fig. 14A
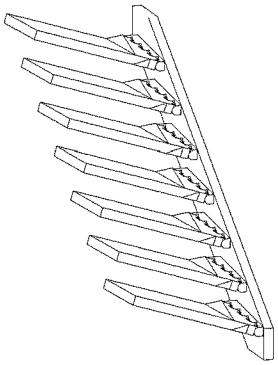
Fig. 14B
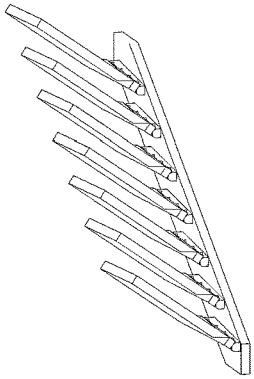
Fig. 14C
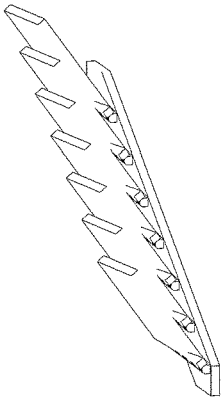
Fig. 14D
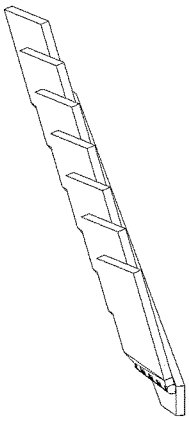
Fig. 14E
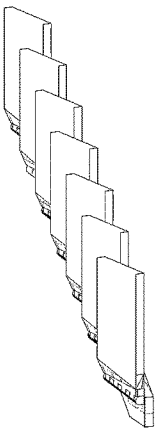
Fig. 14F Figure 15
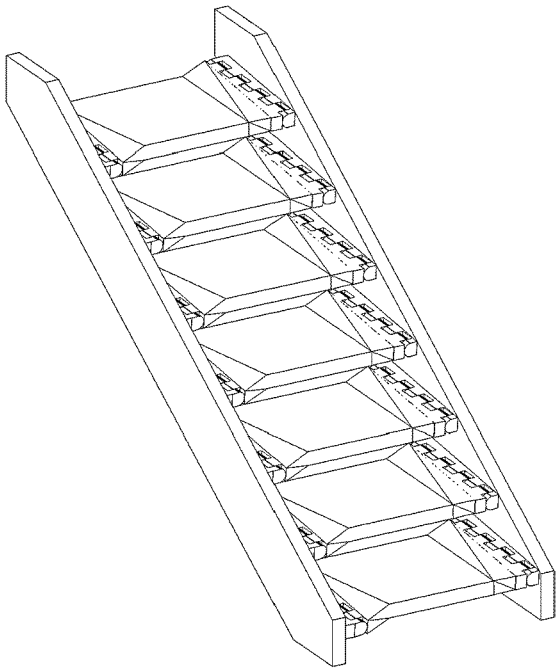
Fig. 15A
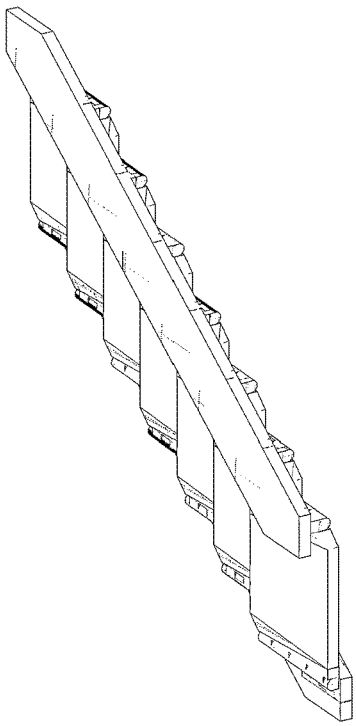
Fig. 15B Figure 16
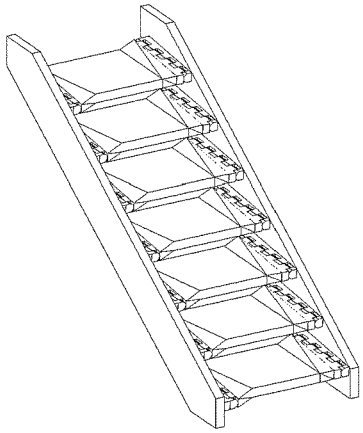
Fig. 16A
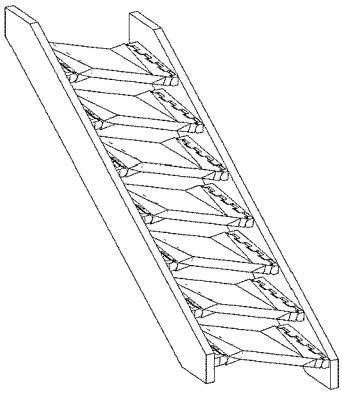
Fig. 16B
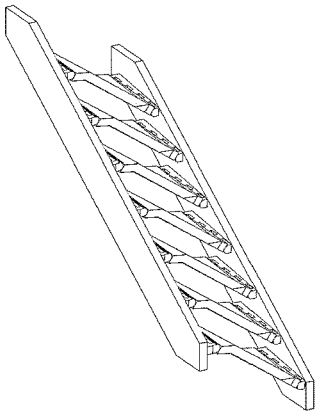
Fig. 16C
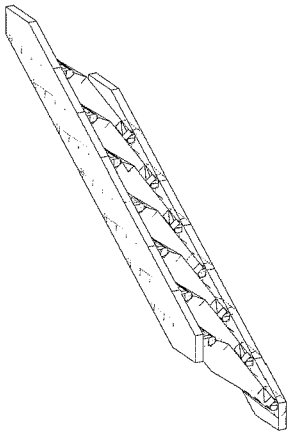
Fig. 16D
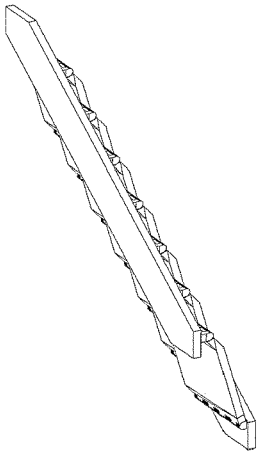
Fig. 16E
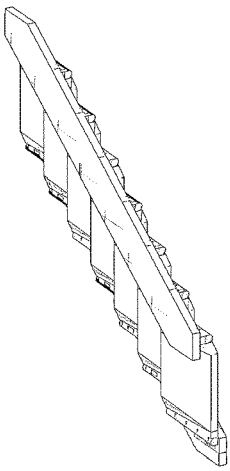
Fig. 16F Figure 17
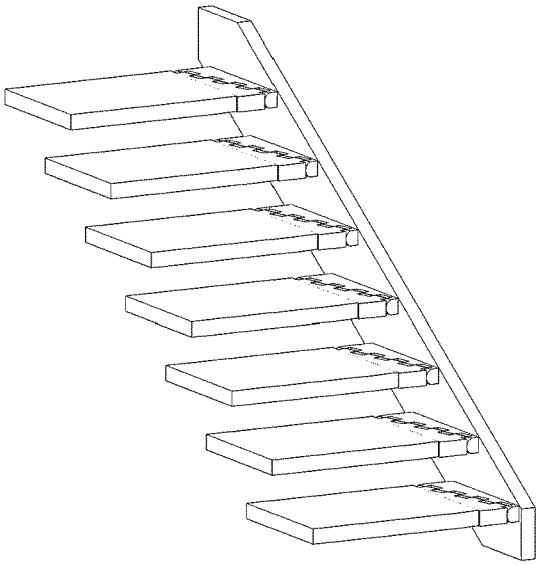
Fig. 17A
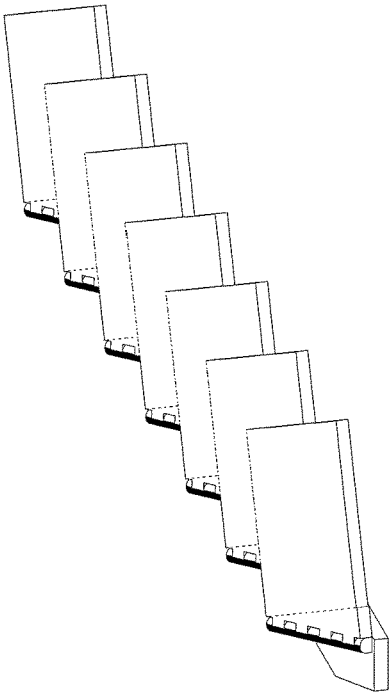
Fig. 17B Figure 18
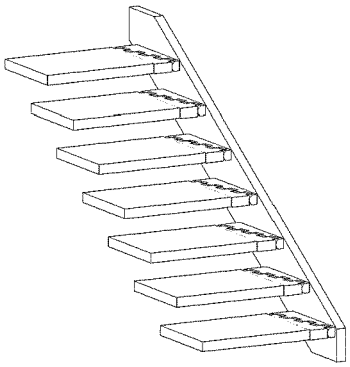
Fig. 18A
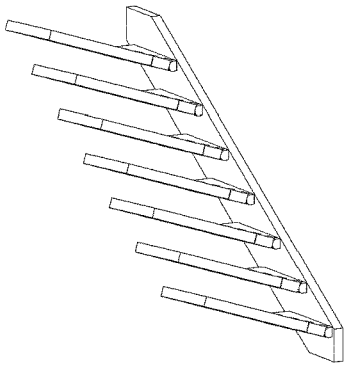
Fig. 18B
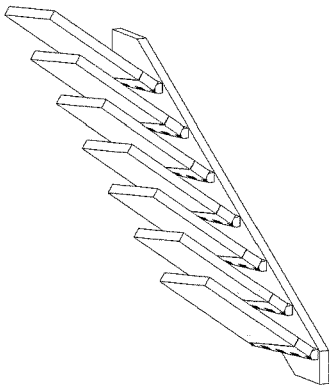
Fig. 18C
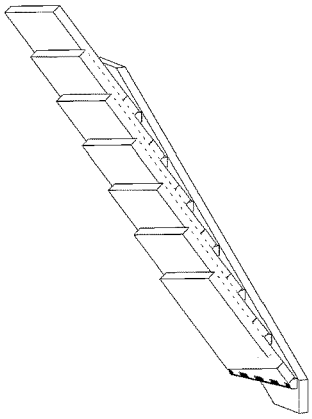
Fig. 18D
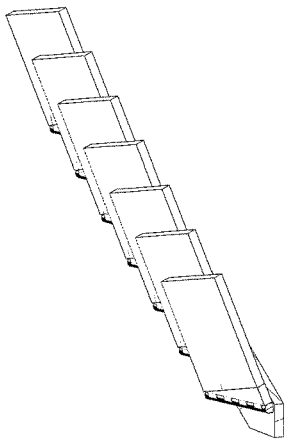
Fig. 18E
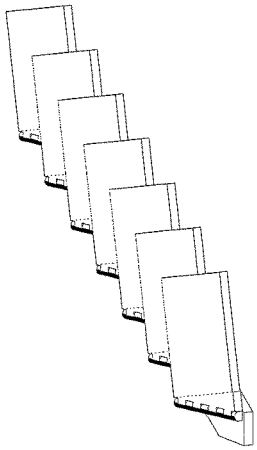
Fig. 18F Figure 19
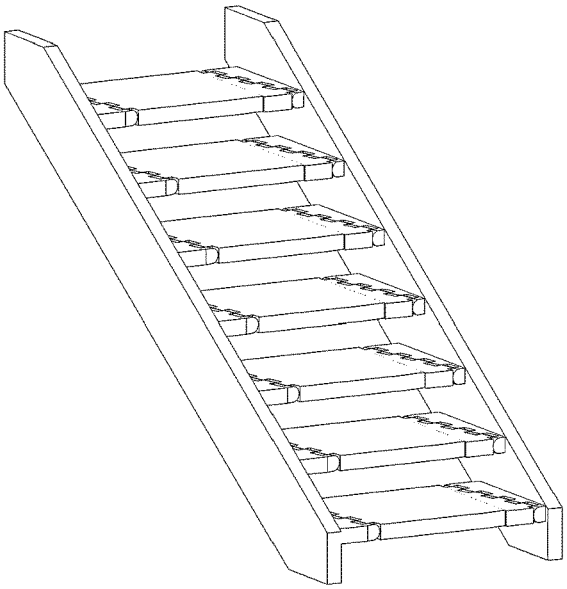
Fig. 19A
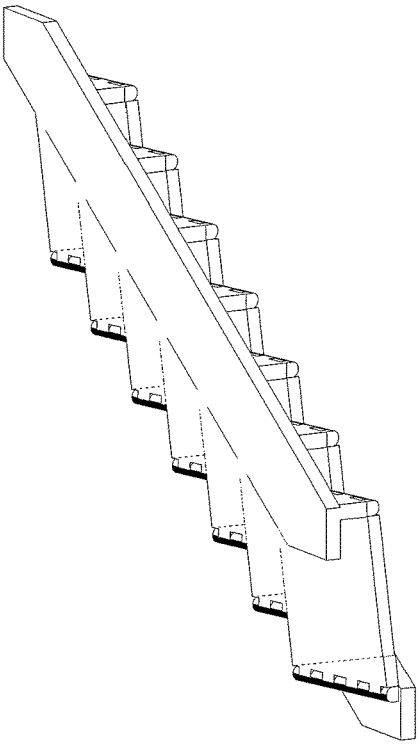
Fig. 19B Figure 20
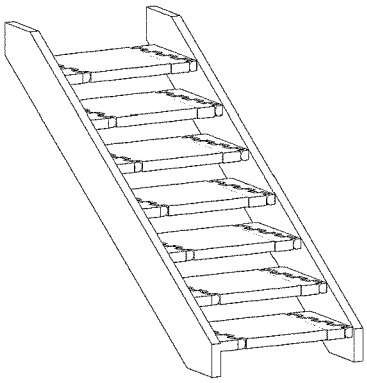
Fig. 20A
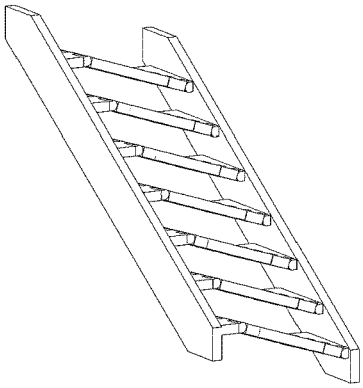
Fig. 20B
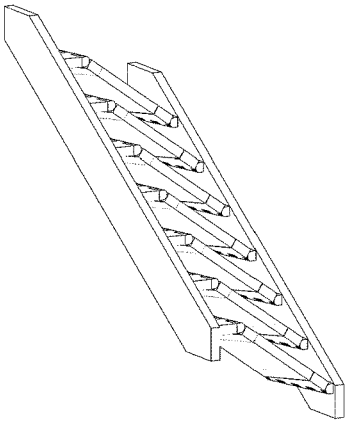
Fig. 20C
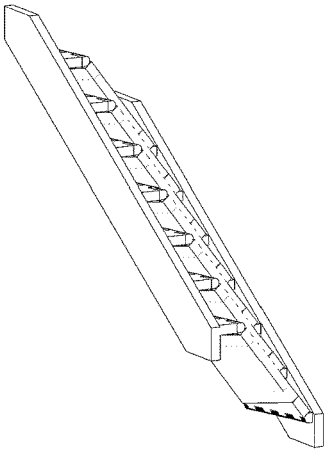
Fig. 20D
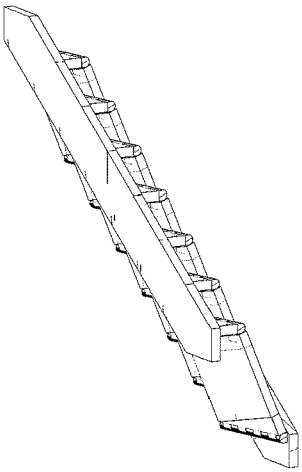
Fig. 20E
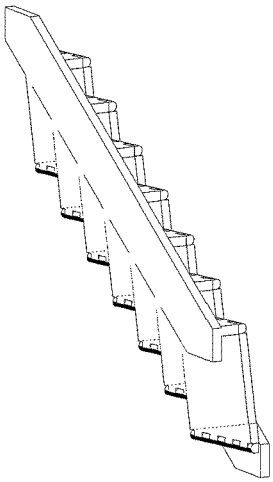
Fig. 20F Figure 21
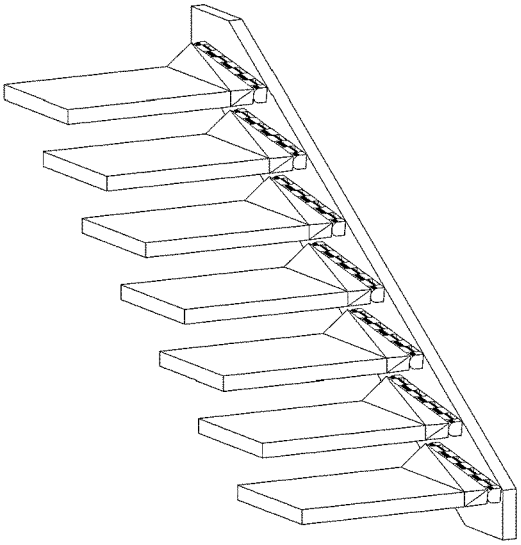
Fig. 21A
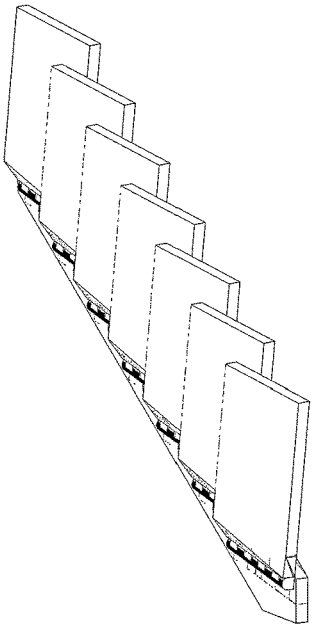
Fig. 21B Figure 22
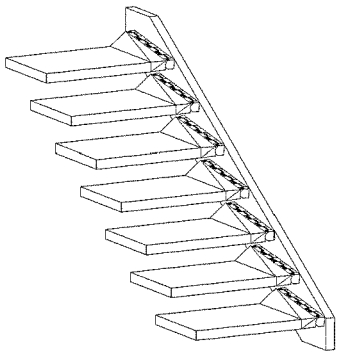
Fig. 22A
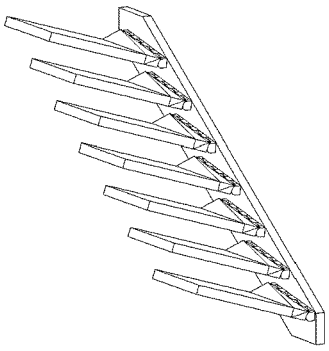
Fig. 22B
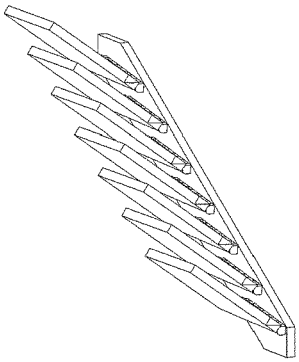
Fig. 22C
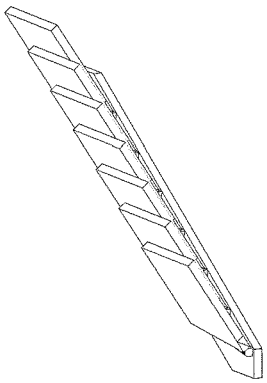
Fig. 22D
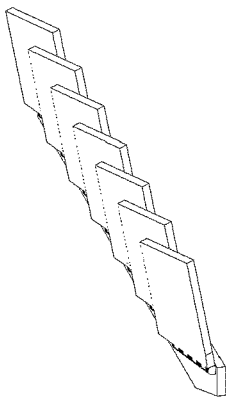
Fig. 22E
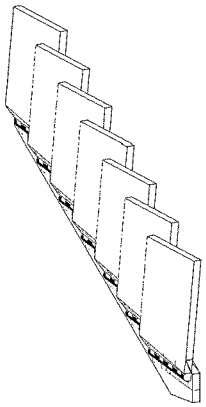
Fig. 22F Figure 23
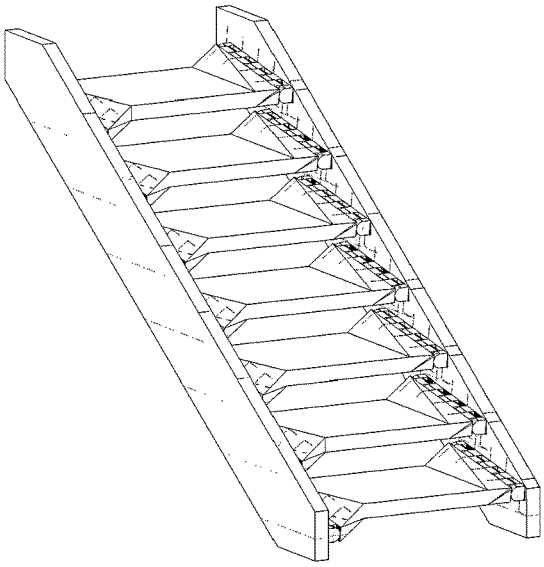
Fig. 23A
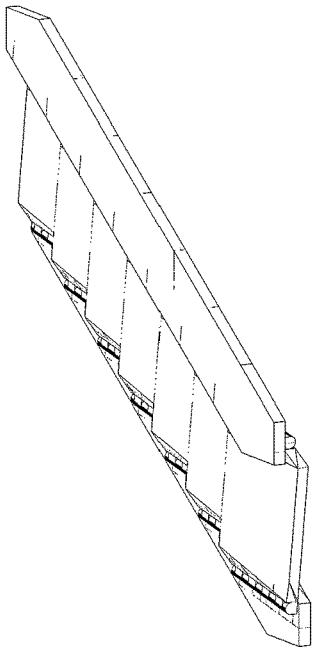
Fig. 23B Figure 24
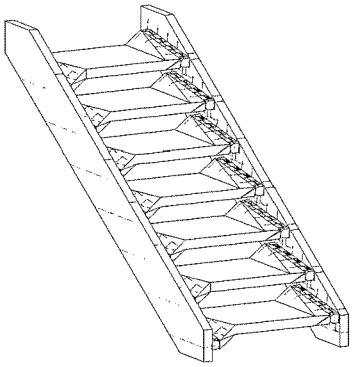
Fig. 24A
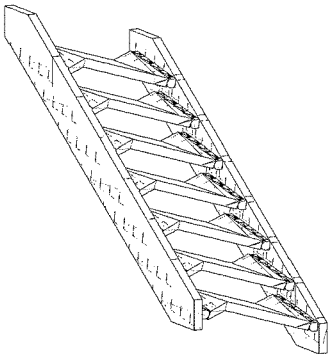
Fig. 24B
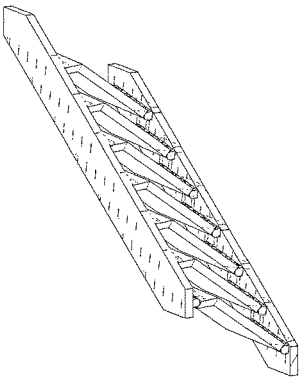
Fig. 24C
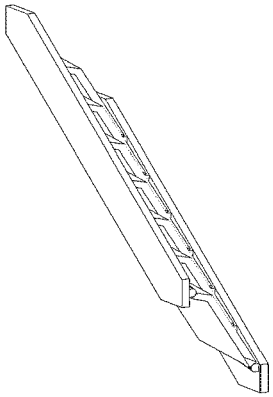
Fig. 24D
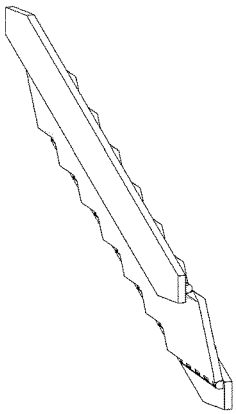
Fig. 24E
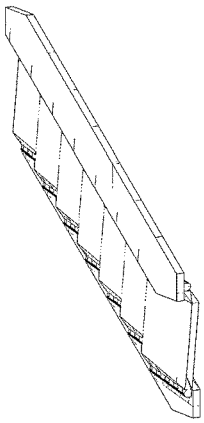
Fig. 24F Figure 25
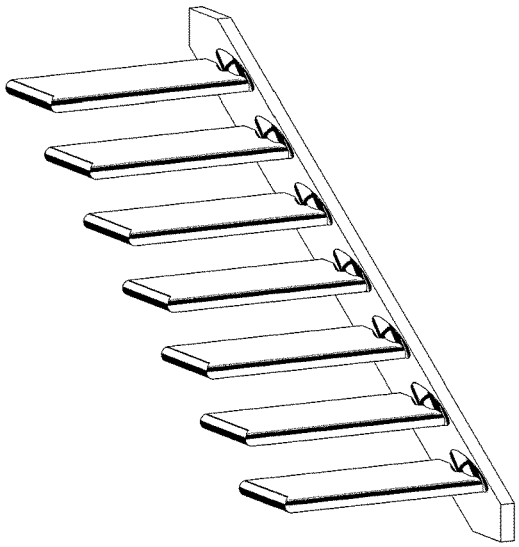
Fig. 25A
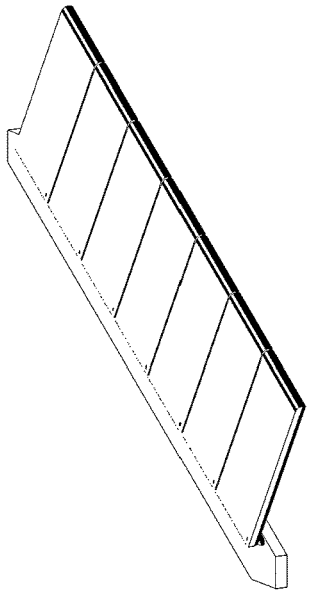
Fig. 25B Figure 26
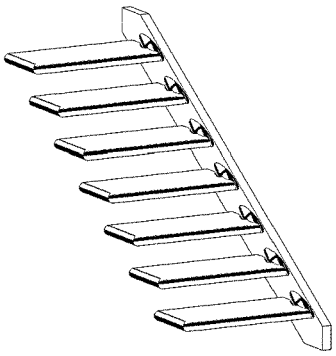
Fig. 26A
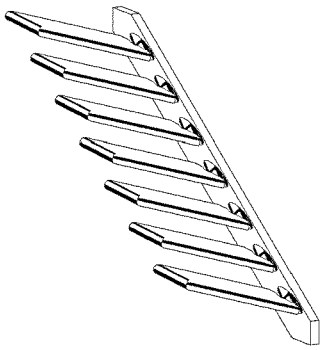
Fig. 26B
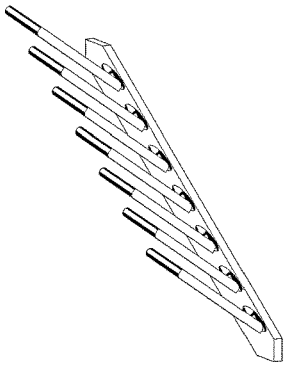
Fig. 26C
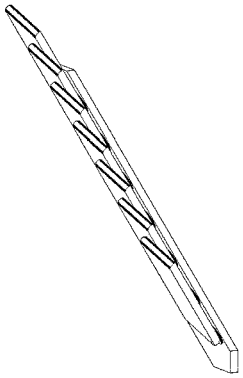
Fig. 26D
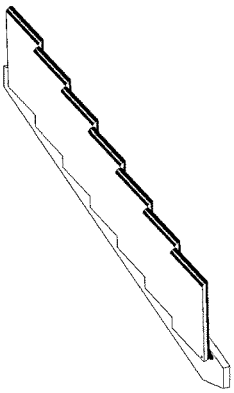
Fig. 26E
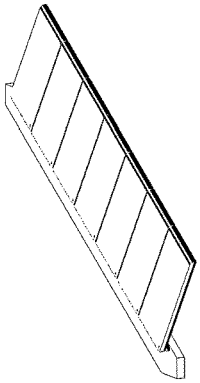
Fig. 26F Figure 27
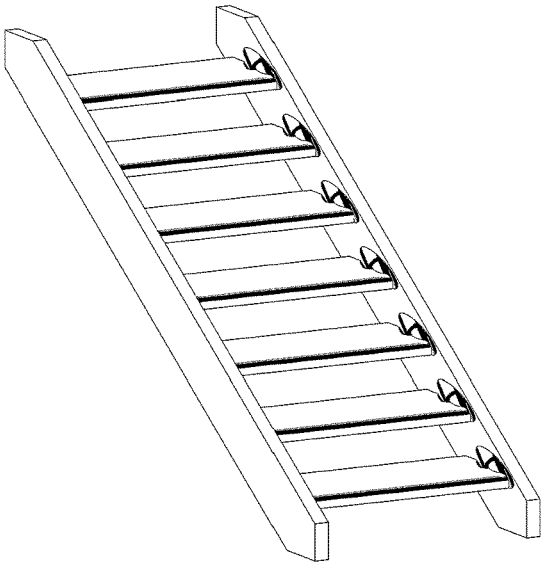
Fig. 27A
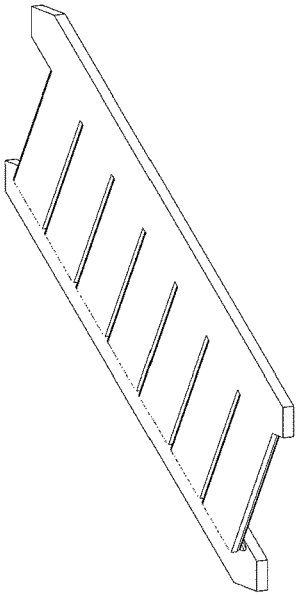
Fig. 27B Figure 28
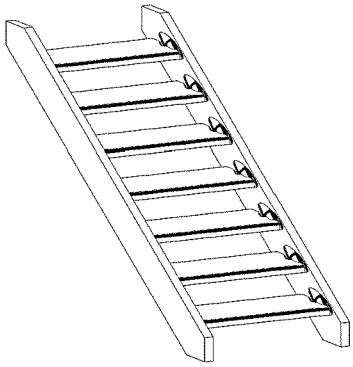
Fig. 28A
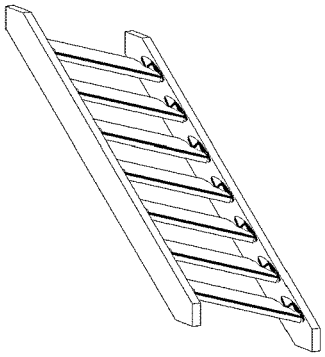
Fig. 28B
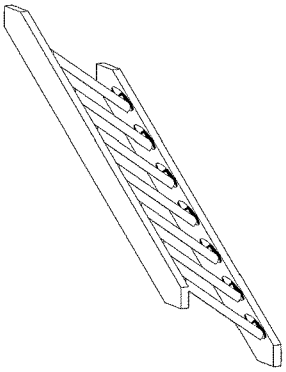
Fig. 28C
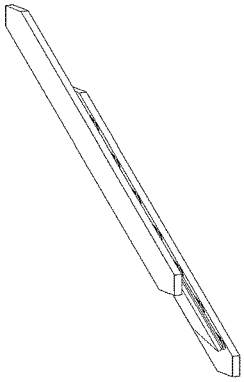
Fig. 28D
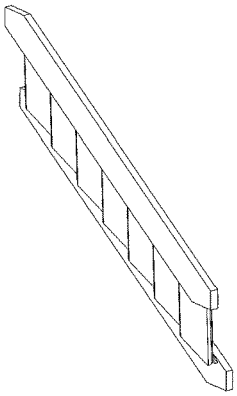
Fig. 28E
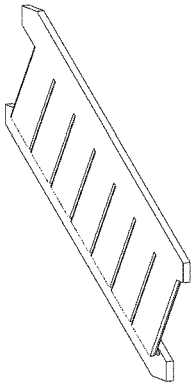
Fig. 28F Figure 29
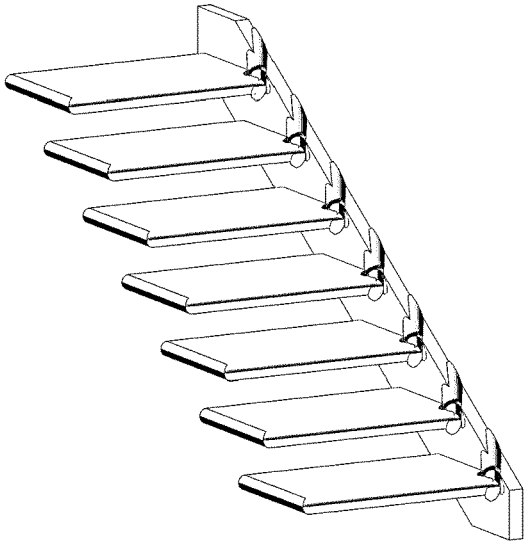
Fig. 29A
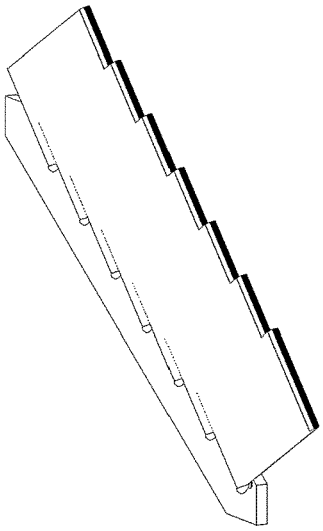
Fig. 29B Figure 30
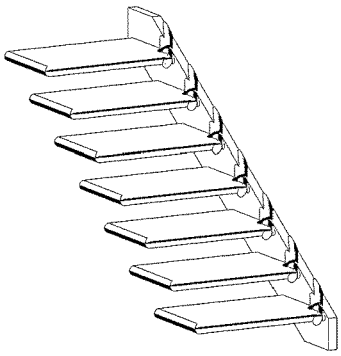
Fig. 30A
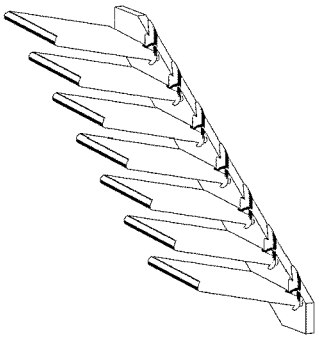
Fig. 30B
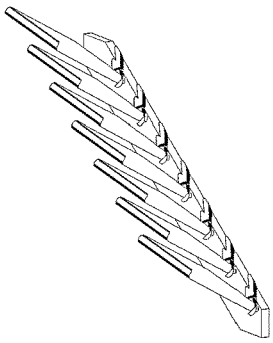
Fig. 30C
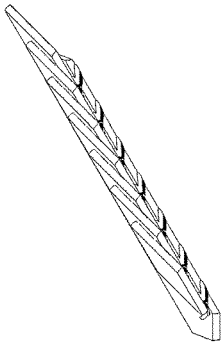
Fig. 30D
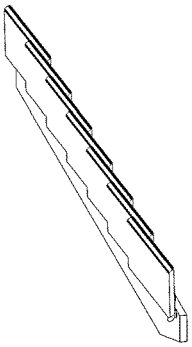
Fig. 30E
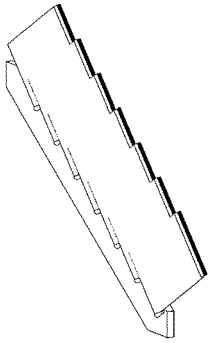
Fig. 30F Figure 31
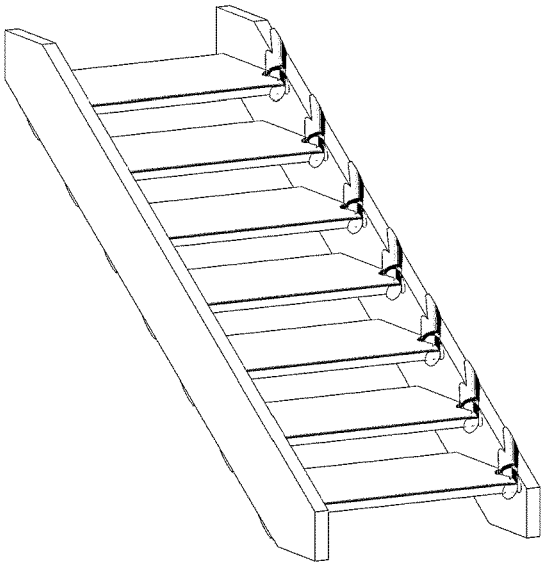
Fig. 31A
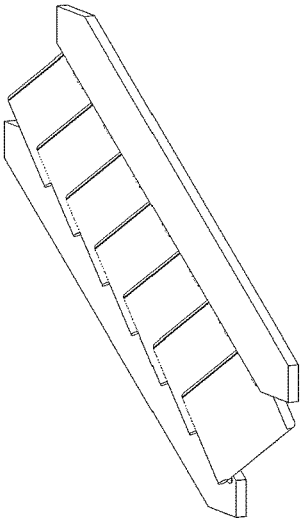
Fig. 31B Figure 32
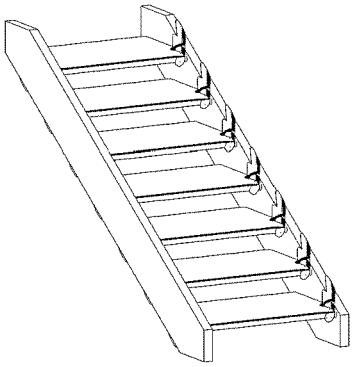
Fig. 32A
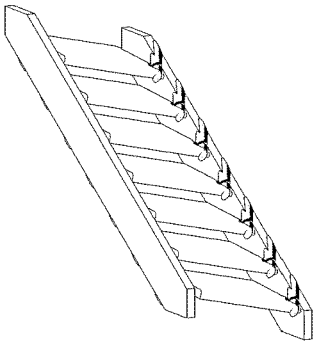
Fig. 32B
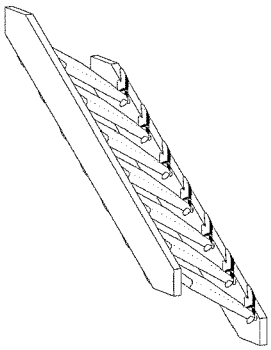
Fig. 32C
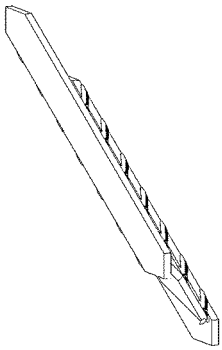
Fig. 32D
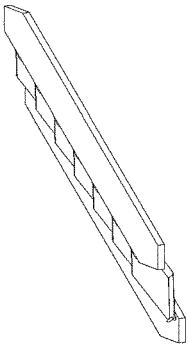
Fig. 32E
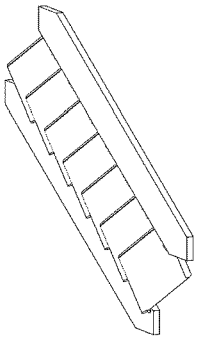
Fig. 32F Figure 33
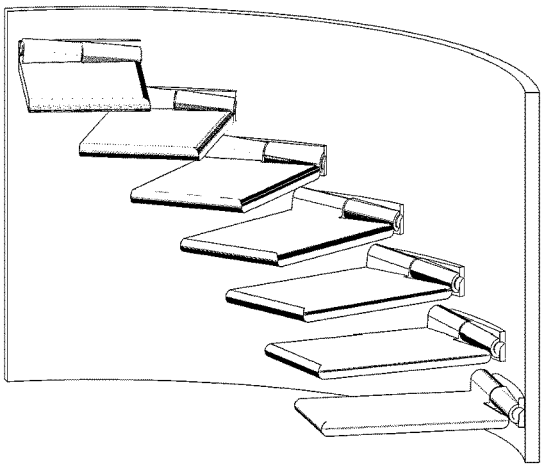
Fig. 33A
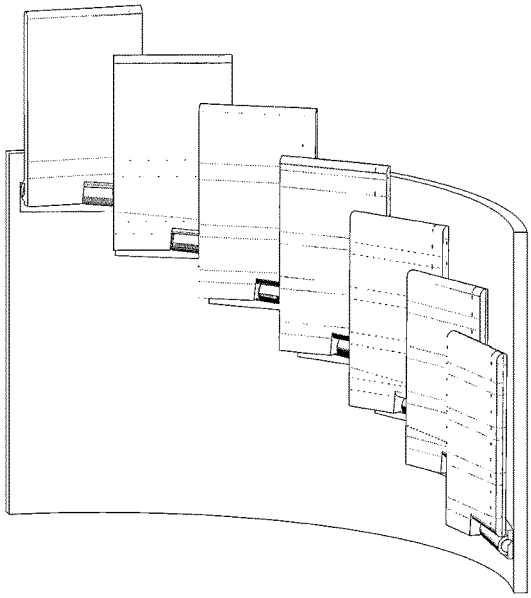
Fig. 33B Figure 34
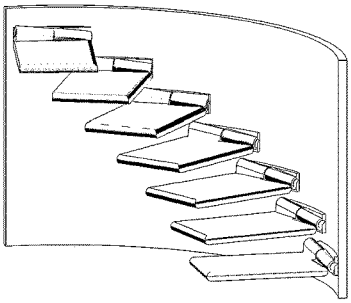
Fig. 34A
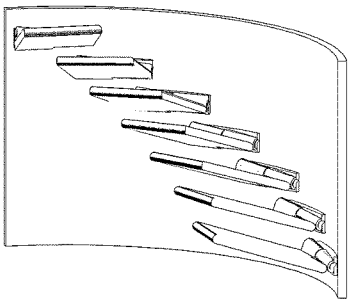
Fig. 34B
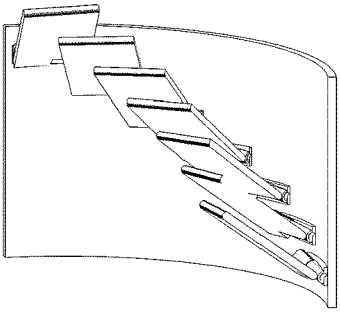
Fig. 34C
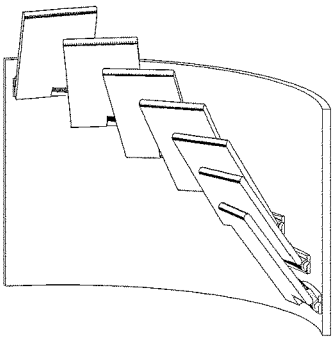
Fig. 34D
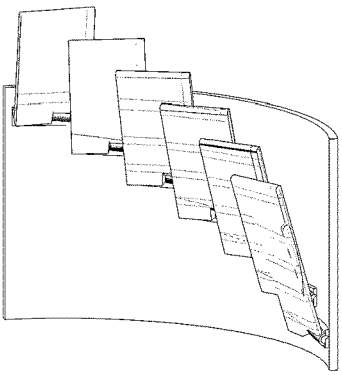
Fig. 34E
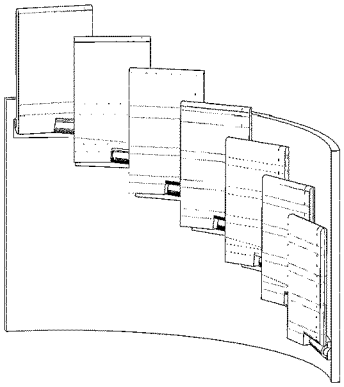
Fig. 34F Figure 35
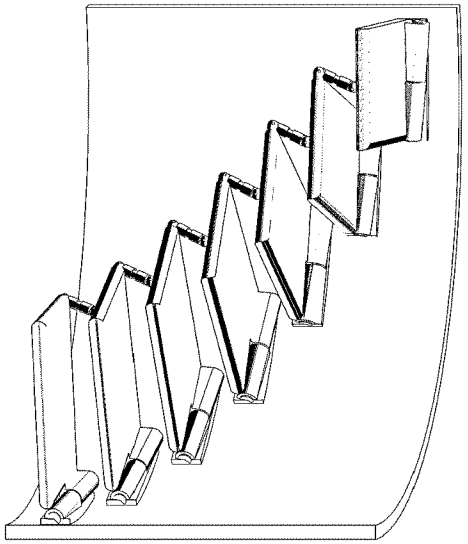
Fig. 35A
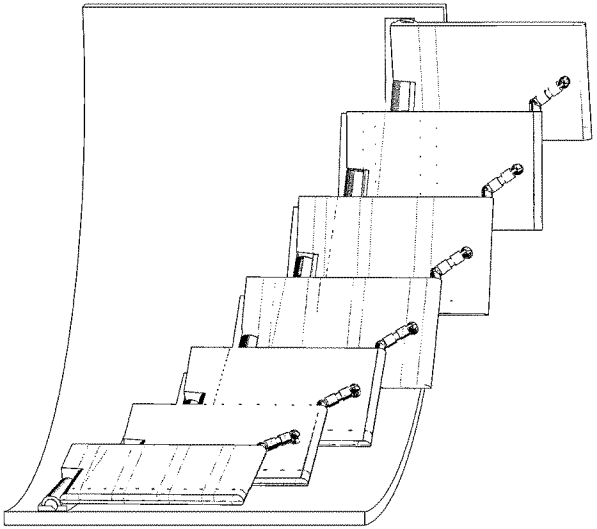
Fig. 35B Figure 36
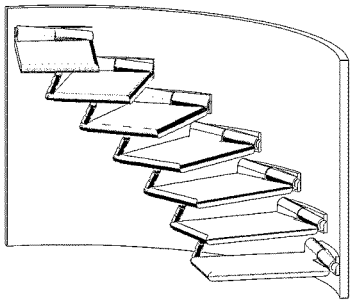
Fig. 36A
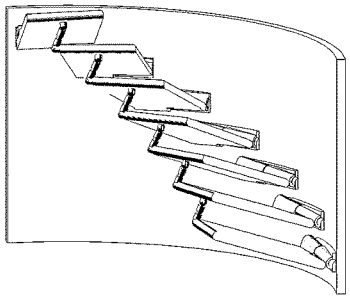
Fig. 36B
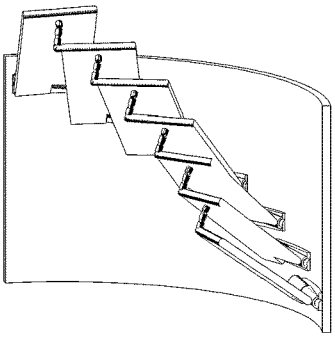
Fig. 36C
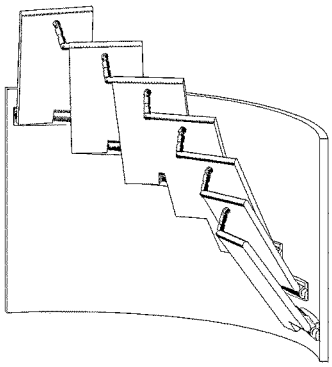
Fig. 36D
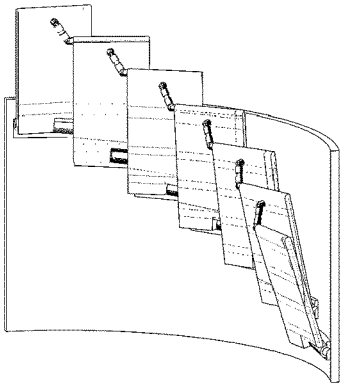
Fig. 36E
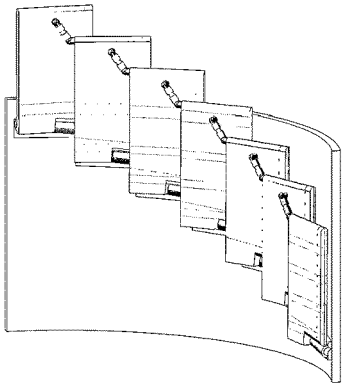
Fig. 36F Figure 37
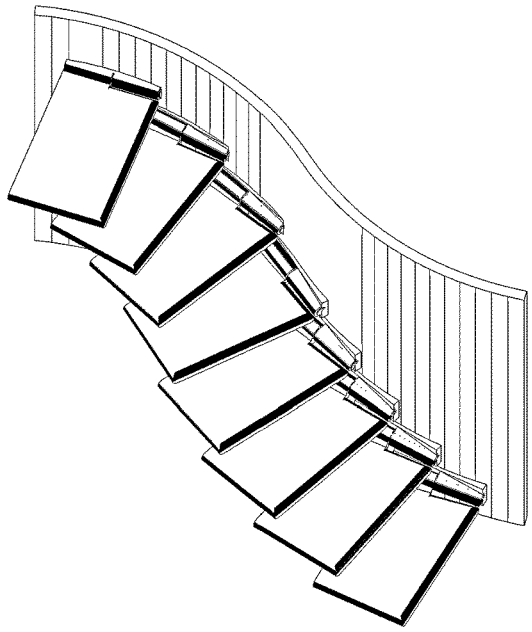
Fig. 37A
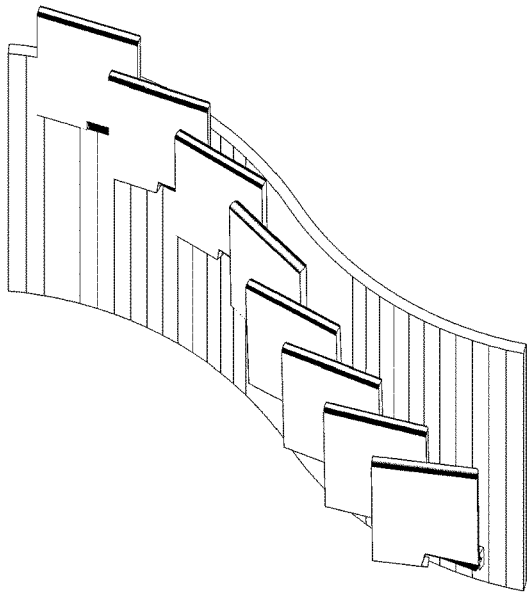
Fig. 37B Figure 38
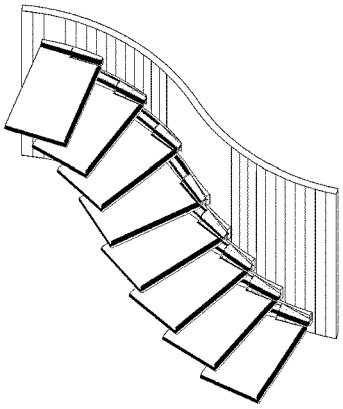
Fig. 38A
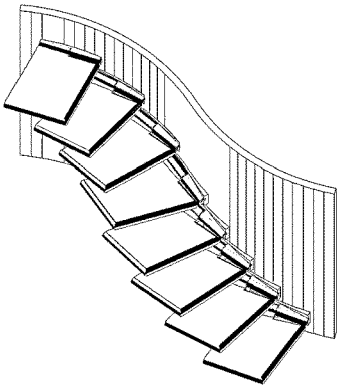
Fig. 38B
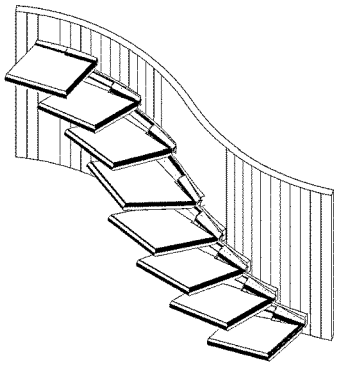
Fig. 38C
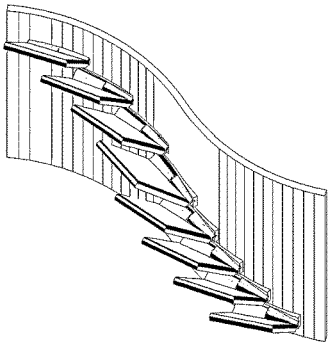
Fig. 38D
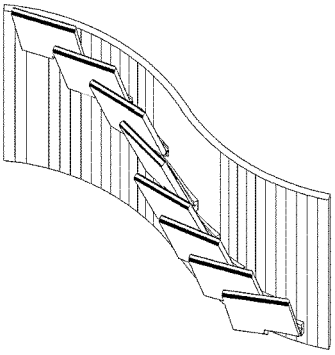
Fig. 38E
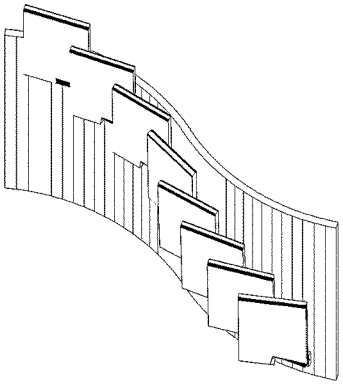
Fig. 38F Figure 39
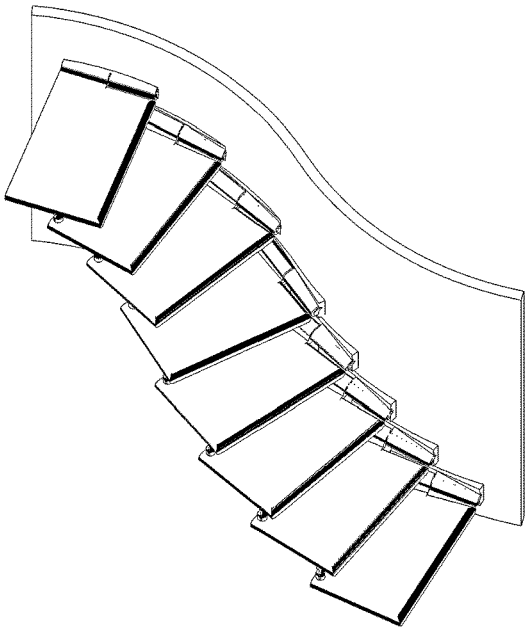
Fig. 39A
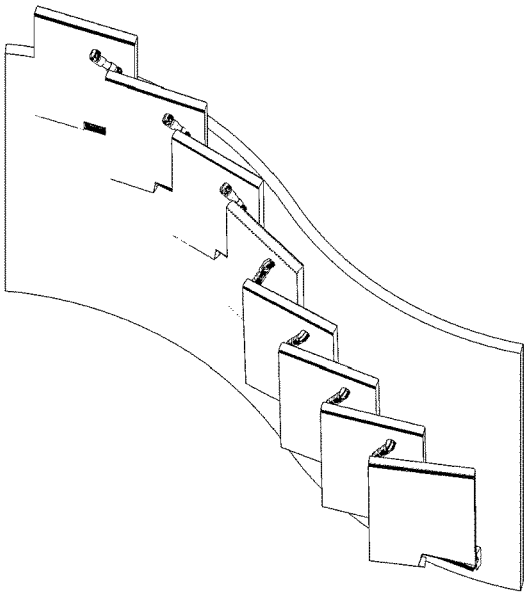
Fig. 39B Figure 40
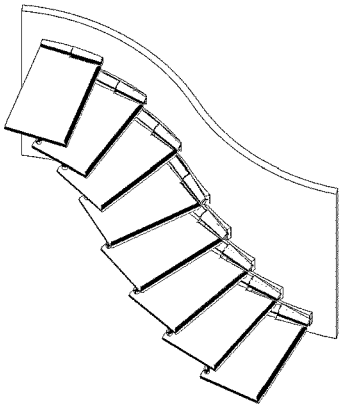
Fig. 40A
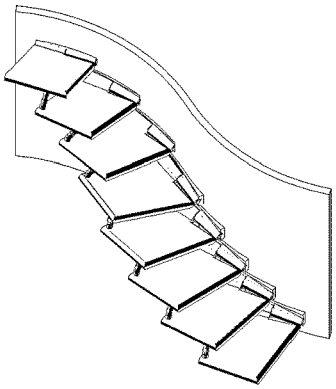
Fig. 40B
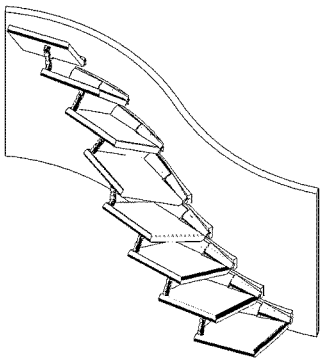
Fig. 40C
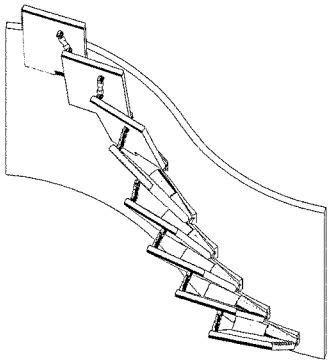
Fig. 40D
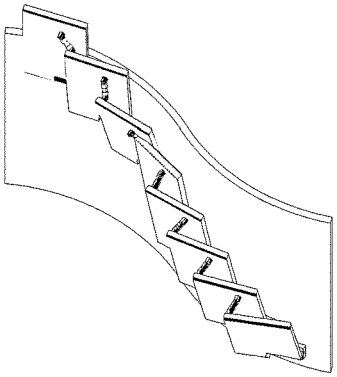
Fig. 40E
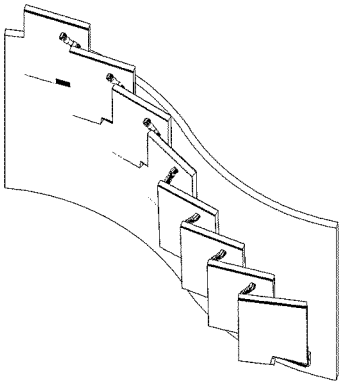
Fig. 40F Figure 41
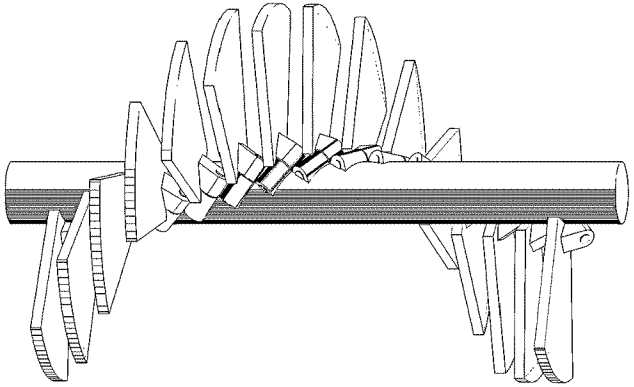
Fig. 41A
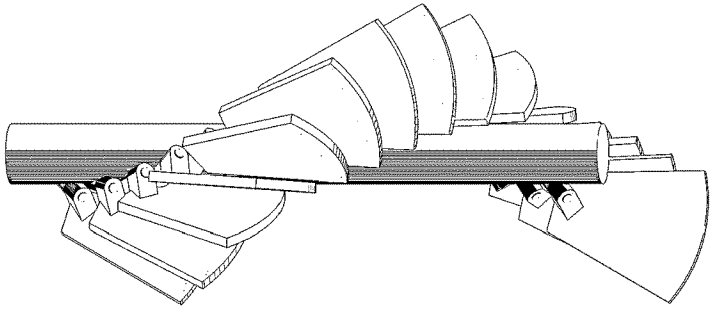
Fig. 41B Figure 42
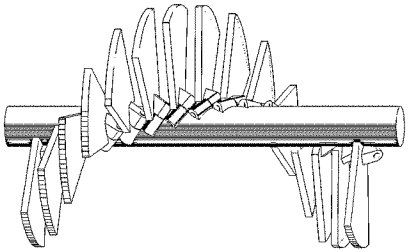
Fig. 42A
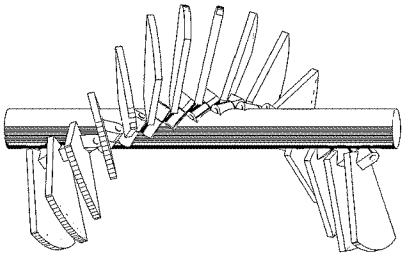
Fig. 42B
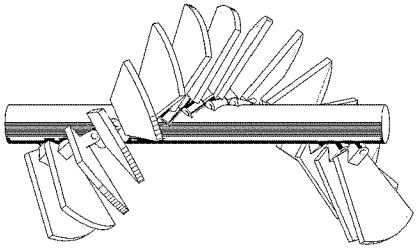
Fig. 42C
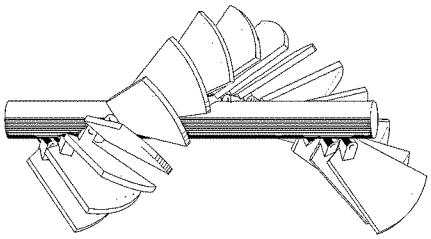
Fig. 42D
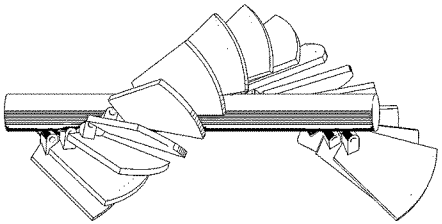
Fig. 42E
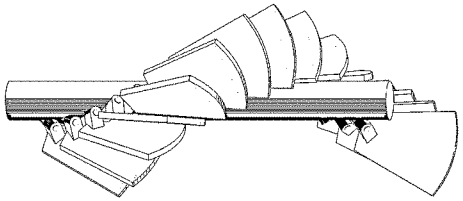
Fig. 42F Figure 43
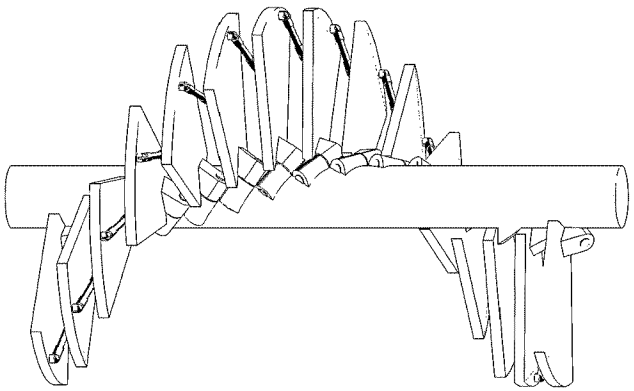
Fig. 43A
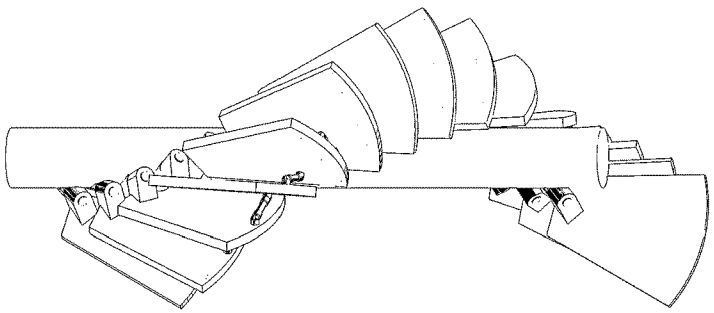
Fig. 43B Figure 44
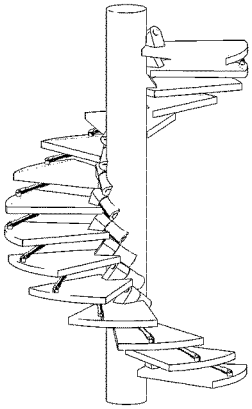
Fig. 44A
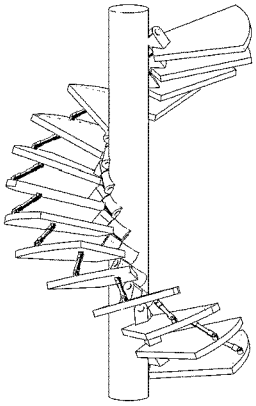
Fig. 44B
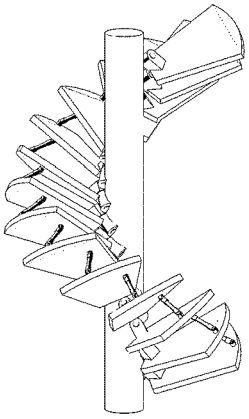
Fig. 44C
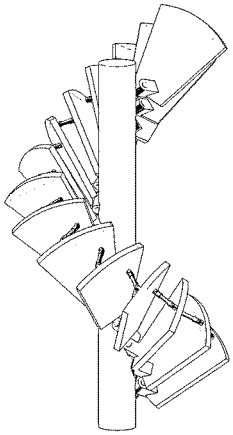
Fig. 44D
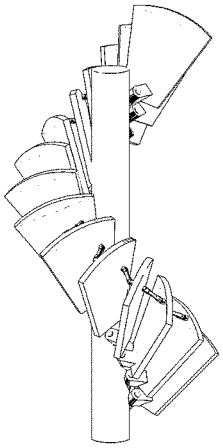
Fig. 44E
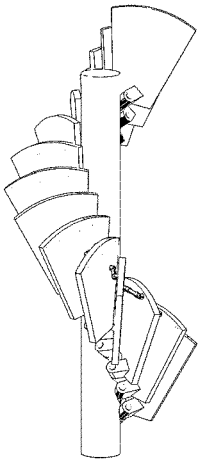
Fig. 44F

FOLDING STAIR WITH TREAD OVERHANG

1 CROSS REFERENCE TO RELATED APPLICATIONS

This application claims the benefit of provisional patent application Ser. No. 63/332,908, filed Apr. 20, 2022 by the present inventor, which is incorporated by reference in its entirety.

2 FIELD

This application relates to stairs and ladders. More specifically, it relates to those which fold, therefore enabling a different use of space when they are stowed compared to when they are deployed.

3 BACKGROUND

Stairs, sequences of flat surfaces wide enough for one to comfortably place his foot, an essential feature of modern buildings and other structures, have been assisting man to ascend vertically for millennia. Stairways survive from ancient Rome, from ancient Egypt, from 4500 year-old Mohenjo-daro, and likely, were formed on mountainsides long before that still.

Folding stairs, a variant which can be moved into a stowed position to enable a different use of space than when deployed, also date back to ancient times, as ladders were used to access higher spaces. In the modern era, advances in engineering have facilitated a variety of folding stairs whose motion between stowed and deployed states is guided by mechanisms designed to maximize efficiency, safety, reliability, and convenience of the apparatus, both when shifting between states, and during traversal.

Recent years have seen a growing trend towards compact and space-saving folding stairs. One example of this is the folding stair shown in FIG. 1. It shows a folding stair comprising a sequence of steps each rotably connected to a stationary stringer. As each step rotates about the axis connecting it to the stringer, they fold into a compact stowed position adjacent to it. FIG. 2 shows a stair similar to that of FIG. 1, with the addition of a moving stringer rotably connected to each step via an axis parallel to the axis already connecting it to the stationary stringer. This forms a parallel-linkage, coordinating the movement of the steps for efficient folding. The folding mechanisms of the stairs shown in FIGS. 1 and 2 enable a smooth transition for each step between the stowed and deployed positions.

However, I've noticed that steps such as these are sometimes difficult to traverse due to having a short tread depth. In the stairs of FIGS. 1 and 2, the tread depth is less than the step run. I've noticed that if the tread depths of this stair were extended beyond the run length, then when folding from their deployed towards their stowed state, once they fold by an angle of arccos $$\left(\frac{\text{thickness}}{\text{rise}}\right),$$

the top of each lower step would collide with the bottom of the step one above it and prevent further folding motion. FIG. 3 shows the same stair of FIGS. 1 and 2 folded by this critical angle. Stairs with shorter tread depths can be more difficult to traverse, and I've found the disadvantages of shorter tread depth to be one of the shortcomings of this prior art.

4 SUMMARY

In accordance with one embodiment: a folding stair comprising a structure, a series of steps, an axis for each step rotably mounting the step to said structure about which the step can pivot, such that each step can rotate between a stowed state and a deployed state, moving to one side of the traversal path when stowed, and oriented to enable the steps, despite having a tread depth exceeding the step run, to have an increased angle of folding without collision.

5 ADVANTAGES

Several advantages of one or more aspects are as follows.

Tread overhang has been a standard feature of fixed stairs for centuries, as it provides the functional advantage of increasing step area by deepening the tread. This leads to increased safety, since the deeper tread provides a more stable surface for the foot, which helps to prevent it from slipping off the edge of the step. Comfort is also improved, with more room for the foot facilitating easier balance, and reducing foot fatigue by distributing weight more evenly across it. These, and other advantages of tread overhang typical of ordinary non-folding stairs, translate to similar advantages when present in the deployed state of folding stairs.

The advantages of increased tread depth have been formally studied, and it was found that deeper treads increased traversal speed, and also improved gait, especially among older users.[1] This demonstrates the advantages of improved safety and comfort resulting from the increased tread depth that tread overhang can enable.

[1] Di Giulio I, Reeves N D, Roys M, Buckley J G, Jones D A, Gavin J P, Baltzopoulos V, Maganaris C N. Stair Gait in Older Adults Worsens With Smaller Step Treads and When Transitioning Between Level and Stair Walking. Front Sports Act Living. 2020 Jun. 25; 2:63. doi: 10.3389/fspor.2020.00063. PMID: 33345054; PMCID: PMC7739576.

Due to these or other advantages, tread overhang is included as standard in many building codes. For instance, in the 2021 International Building Code, a 'nosing', i.e. a portion of the tread which overhangs, is required on certain stairs; IBC Section 1022.5.2 requires that run lengths not be less than 11 inches, but makes an exception for stairs with appropriate tread overhang:

> "A nosing projection not less than ¾ inch (19.1 mm) but not more than 1¼ inches (32 mm) shall be provided on stairways with solid risers where the tread depth is less than 11 inches (279 mm)."[2]

[2] 2021 International Building Code (IBC). 1022.5.2 Riser height and tread depth.

Increased safety and comfort, or other advantages, were sufficient to warrant inclusion of tread overhang in the International Building Code, and those advantages translate to advantages over the prior art. As the IBC suggests, the presence of tread overhang is especially important in cases where step run is restricted, as is common in the space-constrained settings where a folding stair has been utilized to save space.

Folding stairs are ideal for space-constrained settings due to their ability to reveal space when stowed, offering the revealed space to be used differently. This feature also enables them to be installed in areas where a conventional staircase would be impractical or impossible. In addition to the space-revealing features of folding, it can also be used to intentionally prevent traversal when stowed, for example, to add a layer of security or to prevent children from accessing certain areas. These are a few of the advantages offered by folding stairs.

Stairs which, in particular, fold to one side of the traversal path, can be more convenient to stow and deploy as compared with collapsing stairs whose folding requires the steps to undergo a greater distance of step movement. This is while still revealing a significant amount of space from the traversal path.

Simple folding guided by rotating axes has its own convenience advantage, as compared with stairs whose folding motion requires more complex manipulation. Additionally, simple rotation can be more reliable and durable than mechanisms with, e.g. more moving parts, or otherwise, greater complexity.

When the steps' movement is linked by a fold-coordinating means, this can further promote ease of folding by reducing the number of parts which need to be independently manipulated for the stair to fold. Depending on the fold-coordinating means, it can also help distribute load among the steps, or help transfer load to the floor or other structure.

These and other benefits of one or more aspects will become apparent from a consideration of the ensuing description and accompanying drawings.

6 BRIEF DESCRIPTION OF THE DRAWINGS

In the drawings, closely related figures have the same number but different alphabetic suffixes.

FIG. 1 shows an example of prior art.

FIG. 2 shows the same prior art of FIG. 1 with the addition of a fold-coordinating linking mechanism synchronizing the steps' motion.

Figure 1A:
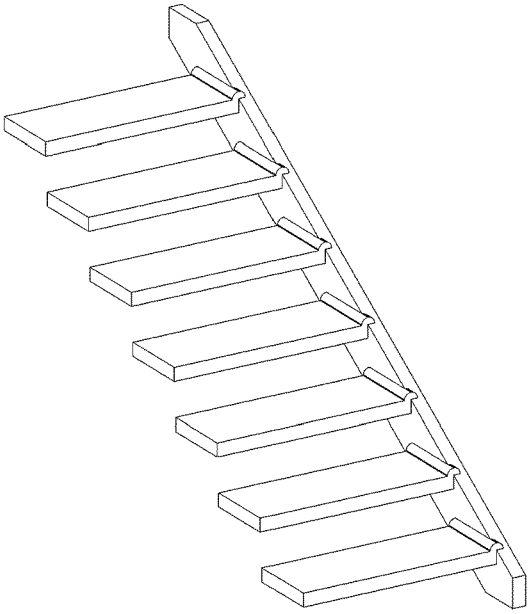
FIG. 1A shows the deployed state.
Figure 1B:
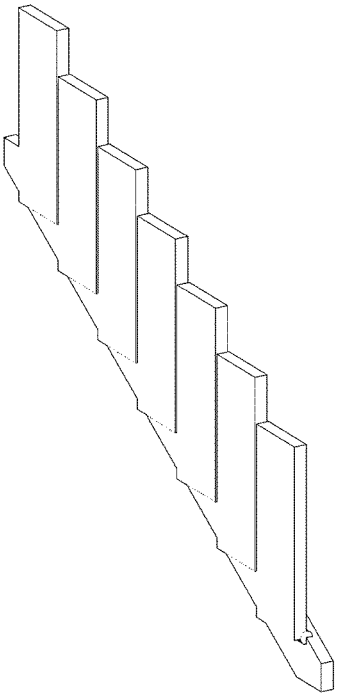
FIG. 1B shows the stowed state.
Figure 2A:
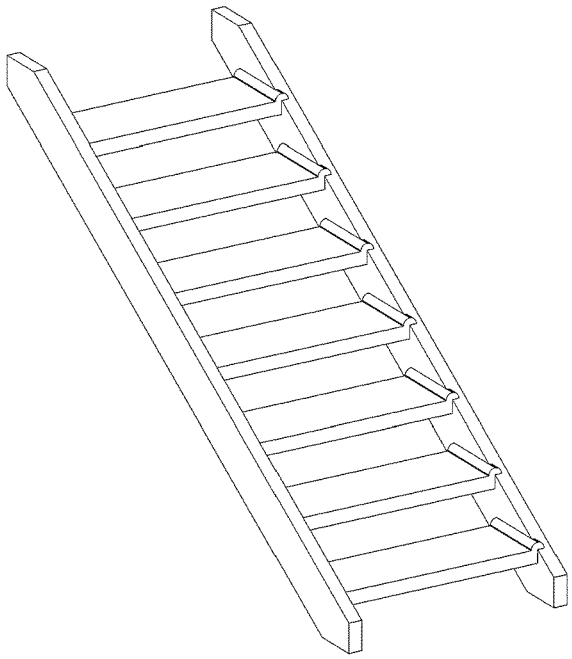
FIG. 2A shows the deployed state and FIG. 2B shows the stowed state.
Figure 2B:
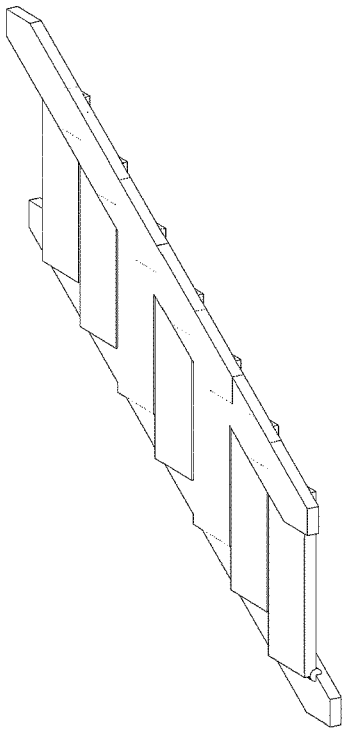
Figure 3A:
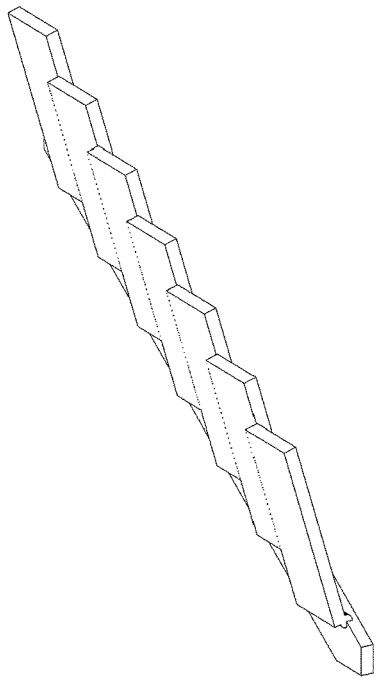
FIG. 3 shows the same prior art of FIGS. 1 and 2 except rotated from the deployed state to fold by an angle of arccos $$\left(\frac{\text{thickness}}{\text{rise}}\right).$$
Figure 3B:
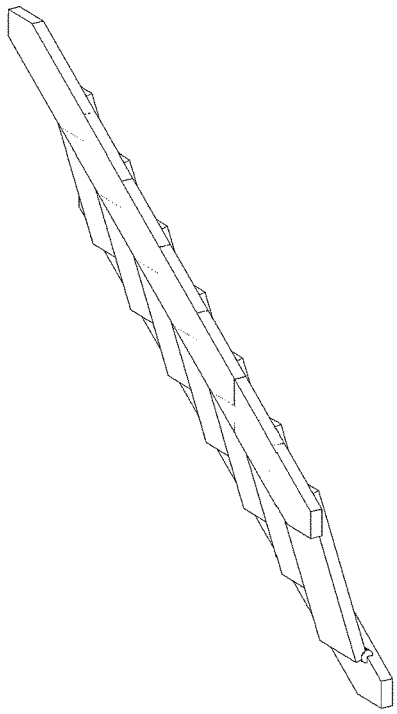

Like FIG. 1, FIG. 3A has no fold-coordinating linking mechanism, and like FIG. 2, FIG. 3B does include such a mechanism synchronizing the steps' motion.

FIG. 4 shows an embodiment (the same embodiment as in FIGS. 5 and 6) from various viewpoints, and certain parts labeled; FIG. 4A shows a side-view, FIG. 4B shows a front-view, FIG. 4C shows a perspective view, FIG. 4D shows a top view, FIG. 4E shows a perspective view stowed, and FIG. 4F shows a top view stowed.

FIGS. 5 and 6 show an embodiment in which wedge-shaped elements orient the axes; FIG. 5A shows the deployed state, FIG. 5B shows the stowed state, and FIG. 6A through FIG. 6F show that same wedge-embodiment at those and various other positions throughout its folding trajectory.

FIGS. 7 and 8 show the wedge-embodiment of FIGS. 5 and 6 with the addition of a fold-coordinating linking mechanism synchronizing the steps' motion. FIG. 7A shows the deployed state, FIG. 7B shows the stowed state, and FIG. 8A through FIG. 8F show that same embodiment at those and various other positions throughout its folding trajectory.

FIGS. 9 and 10 show an embodiment with a 2-barrel axis element. FIG. 9A shows the deployed state, FIG. 9B shows the stowed state, and FIG. 10A through FIG. 10F show that same embodiment at those and various other positions throughout its folding trajectory.

FIGS. 11 and 12 show the two-barrel axis embodiment of FIGS. 9 and 10 with the addition of a fold-coordinating linking mechanism synchronizing the steps' motion. FIG. 11A shows the deployed state, FIG. 11B shows the stowed state, and FIG. 12A through FIG. 12F show that same embodiment at those and various other positions throughout its folding trajectory.

FIGS. 13 and 14 show an embodiment which uses a mortise hinge to form the rotating axes, and with each axis located within (i.e. between the top and bottom of) the step. FIG. 13A shows the deployed state, FIG. 13B shows the stowed state, and FIG. 14A through FIG. 14F show that same embodiment at those and various other positions throughout its folding trajectory.

FIGS. 15 and 16 show the mortise-hinge-embodiment of FIGS. 15 and 16 with the addition of a fold-coordinating linking mechanism synchronizing the steps' motion. FIG. 15A shows the deployed state, FIG. 15B shows the stowed state, and FIG. 16A through FIG. 16F show that same embodiment at those and various other positions throughout its folding trajectory.

FIGS. 17 and 18 show an embodiment in which the axes of rotation are parallel to the tread (though is skew to the direction of traversal). FIG. 17A shows the deployed state, FIG. 17B shows the stowed state, and FIG. 18A through FIG. 18F show that same embodiment at those and various other positions throughout its folding trajectory.

FIGS. 19 and 20 show the parallel-to-tread-embodiment of FIGS. 17 and 18 with the addition of a fold-coordinating linking mechanism synchronizing the steps' motion. FIG. 19A shows the deployed state, FIG. 19B shows the stowed state, and FIG. 20A through FIG. 20F show that same embodiment at those and various other positions throughout its folding trajectory.

FIGS. 21 and 22 show an embodiment in which the axes of rotation are parallel to the direction of traversal (though is skew to the tread plane). FIG. 21A shows the deployed state, FIG. 21B shows the stowed state, and FIG. 22A through FIG. 22F show that same embodiment at those and various other positions throughout its folding trajectory.

FIGS. 23 and 24 show the parallel-to-traversal-direction-embodiment of FIGS. 21 and 22 with the addition of a fold-coordinating linking mechanism synchronizing the steps' motion. FIG. 23A shows the deployed state, FIG. 23B shows the stowed state, and FIG. 24A through FIG. 24F show that same embodiment at those and various other positions throughout its folding trajectory.

FIGS. 25 and 26 show an embodiment in which the steps, despite overhanging in the deployed state, do not overlay in the stowed state. FIG. 25A shows the deployed state, FIG. 25B shows the stowed state, and FIG. 26A through FIG. 26F show that same embodiment at those and various other positions throughout its folding trajectory.

FIGS. 27 and 28 show the no-overlay-in-stowed-state-embodiment of FIGS. 25 and 26 with the addition of a fold-coordinating linking mechanism synchronizing the steps' motion. FIG. 27A shows the deployed state, FIG. 27B shows the stowed state, and FIG. 28A through FIG. 28F show that same embodiment at those and various other positions throughout its folding trajectory.

FIGS. 29 and 30 show an embodiment in which the steps fold substantially forward; in the stowed state the steps' leading edges are more horizontal than vertical. FIG. 29A shows the deployed state, FIG. 29B shows the stowed state, and FIG. 30A through FIG. 30F show that same embodiment at those and various other positions throughout its folding trajectory.

FIGS. 31 and 32 show the forward-embodiment of FIGS. 29 and 30 with the addition of a fold-coordinating linking mechanism synchronizing the steps' motion. FIG. 31A shows the deployed state, FIG. 31B shows the stowed state, and FIG. 32A through FIG. 32F show that same embodiment at those and various other positions throughout its folding trajectory.

FIGS. 33 and 34 show an embodiment in which the structure is a well-like cylinder with steps on the inside, and the axes are skew. FIG. 33A shows the deployed state, FIG. 33B shows the stowed state, and FIG. 34A through FIG. 34F show that same embodiment at those and various other positions throughout its folding trajectory.

FIGS. 35 and 36 show the well-embodiment of FIGS. 33 and 34 with the addition of fold-coordinating linkage mechanisms synchronizing the steps' motion. FIG. 35A shows the deployed state, FIG. 35B shows the stowed state, and FIG. 36A through FIG. 36F show that same embodiment at those and various other positions throughout its folding trajectory.

FIGS. 37 and 38 show an embodiment in which the structure is a curved wall, and the various steps' axes are not all parallel. FIG. 37A shows the deployed state, FIG. 37B shows the stowed state, and FIG. 38A through FIG. 38F show that same embodiment at those and various other positions throughout its folding trajectory.

FIGS. 39 and 40 show the curved-wall-embodiment of FIGS. 37 and 38 with the addition of fold-coordinating linkage mechanisms synchronizing the steps' motion. FIG. 39A shows the deployed state, FIG. 39B shows the stowed state, and FIG. 40A through FIG. 40F show that same embodiment at those and various other positions throughout its folding trajectory.

FIGS. 41 and 42 show an embodiment in which the structure is a pillar around which the steps spiral. FIG. 41A shows the deployed state, FIG. 41B shows the stowed state, and FIG. 42A through FIG. 42F show that same embodiment at those and various other positions throughout its folding trajectory.

FIGS. 43 and 44 show the column-embodiment of FIGS. 41 and 42 with the addition of fold-coordinating linkage mechanisms synchronizing the steps' motion. FIG. 43A shows the deployed state, FIG. 43B shows the stowed state, and FIG. 44A through FIG. 44F show that same embodiment at those and various other positions throughout its folding trajectory.

7 TERM REFERENCE

Reference Numerals

101 step
102 structure
103 axis
104 thickness
105 width
106 tread depth
107 rise
108 run
109 tread overhang
110 inclination offset
111 azimuth offset

Glossary stair
: The sequence of steps and associated elements, taken as a whole.

sequence
: A collection of items in which each element except the first has a unique antecedent. A sequence of steps in a stair will have a top step, a step below leading to it, and possible further steps each leading to the next. Thus the first element in the sequence is the top step, and the unique antecedent of each other step is the step above it. Or, alternatively, if the first element in the sequence is the bottom step, then the unique antecedent of each other step is the step below it.

step (101)
: The rigid body supporting the tread. The part which rotates between the deployed and stowed states.

tread
: A component of each step; the substantially flat surface forming a stage of the traversal path. Substantially level when the step is in the deployed state.

structure (102)
: The rigid body to which the steps are rotably attached via the axes. The structure fixes the orientation of the axes relative to it.

axis (103)
: For each step, its axis is its means of facilitating rotation between deployed and stowed states, and the line in 3d space about which the step rotates. In other words: an axis is the means by which a step is constrained to rotate relative to the structure, and its location and orientation are of the geometric line about which that rotation occurs.

axis orientation
: The pointing direction of an axis. The component of axis placement that is determined or altered by rotating the axis line about one of its points.
: The orientation is defined by its inclination offset and azimuth offset, relative to the deployed tread, and horizontal traversal path, respectively.

axis location
: The place at which the axis is positioned. The component of axis placement that is determined or altered by translating the axis line. Together, an axis's location and its orientation define its position and pointing direction in space.

deployed state
: The placement of a step in which it is traversable, e.g. in which the tread is level. Also called deployed position.

stowed state
: The placement of a step in which it has moved from forming the traversal path of the deployed state, thus revealing that space or serving other advantages of folding such as preventing traversal. Also called stowed position.

fold
: The steps' movement between deployed and stowed states.

traversal path
: The course taken by a traverser ascending or descending the stair; the path along the steps when they are in their deployed state.

horizontal component of the traversal path
: The traversal path direction projected into a horizontal plane (such as that of the deployed tread). The direction along the level plane of a deployed tread aligning with the path a traverser would take.

horizontal traversal path

The traversal path projected into a horizontal plane (such as that of the deployed tread). The path along the level surface of a deployed tread aligning with the path a traverser would take.

thickness (104)

The thickness of a step is the measure from the tread to the other side. In a step's deployed state, the thickness is the vertical distance through the step from top to bottom.

If different parts of a step have different thicknesses, the relevant thickness of the step is, in the deployed state, that of the thickest portion that overhangs the step below it.

width (105)

In the deployed state, the measure of a step's tread transverse to the traversal path; the length of the tread between its left and right sides.

If different parts of a step have different widths, then the relevant width of the step is that of the widest portion that, in the deployed state, is below the overhang of the step above.

depth (106)

A step's depth (or tread depth) is, in its deployed state, its horizontal dimension along the traversal path; the length across the tread, along the horizontal traversal path, from front to back.

rise (107)

In the deployed state, the vertical measure between treads of adjacent steps; the vertical measure from a step's tread to the tread of the step above.

For a given step, the rise of that step is between itself and the step above.

run (108)

A step's run (also called step run) is its measure, in the deployed state, along the horizontal traversal path from its leading edge to below the leading edge of the step above. That is, the measure along the horizontal traversal path between the leading edges of adjacent steps.

For a given step, the run of that step is between itself and the step above.

tread overhang (109)

Where a step's tread depth exceeds its step run and therefore the step above overhangs part of it. With tread overhang, part of the upper step is located above part of the lower step, which increases tread area for a given step run.

Insofar as the step exhibits tread overhang, the run will be less than the tread depth. But note that for some embodiments, these measures will be different for different leading edge points. In such cases, each leading edge point will have its own run as well as its own tread depth, according to its respective measures along the horizontal traversal path. For the purpose of determining whether a step exhibits tread overhang, only one such point need exhibit tread overhang. In other words:

If there is any leading edge point for which the tread depth of that point exceeds the step run of that point, then the step exhibits tread overhang.

inclination offset (110)

The angle subtended between the axis and a level horizontal plane (such as that of the deployed tread). The inclination offset is nonzero when the axis is skew to the tread.

The sign, positive or negative, is defined as the sign of the vertical component of the axis along its 'back' direction. In other words: point and trace along the axis from front to back, according to the directions 'front' and 'back' relative to the stair as defined below. If the traced point rises vertically, then the inclination offset is positive. If, alternatively, the traced point decreases in height when tracing along the axis from the front towards the back of the stair, then the inclination offset is negative.

azimuth offset (111)

The angle within a horizontal plane between the axis and the direction of the traversal path.

In more detail: Project both the axis and the traversal path direction into a horizontal plane. The azimuth offset is then the counterclockwise angle (when looking down from above) from the horizontal component of the traversal path to the projected axis.

skew to tread

An axis being skew to the step's tread, means it has a nonzero inclination offset.

skew to horizontal traversal path

An axis being skew to the horizontal traversal path, i.e. skew to the horizontal component of the traversal path, means it has a nonzero azimuth offset.

skew

Not parallel. A given line being skew to a given plane means no possible translation of the line could carry the line to lie within the plane.

arccosine of thickness over rise arccos $$\left(\frac{\text{thickness}}{\text{rise}}\right).$$

The arccosine of the ratio whose denominator is the step's rise and whose numerator is the step above's thickness. This is the angle that a step with overhang would rotate before colliding with the step above, if the axis orientation were both parallel to the (deployed) tread (i.e. having zero inclination offset), and parallel to the horizontal direction of traversal (i.e. having zero azimuth offset). It turns out that steps can be made to rotate further than this angle, while still folding effectively, by selecting certain skew axis orientations.

horizontal

Lying in the level plane.

stringer

A form of the structure for some embodiments; a simple rigid element alongside the traversal path.

column

A form of the structure for some embodiments; a central structural element around which the traversal path spirals.

wall

A form of the structure for some embodiments; a wall alongside the traversal path.

front, forward

The horizontal component of the traversal path pointing in the descending direction.

The front side of the stair is therefore the side having the bottom step.

back, backward

The horizontal component of the traversal path pointing in the ascending direction.

The back side of the stair is therefore the side having the top step.

fold-coordinating means

Coordinates the folding motion of the steps in a stair. For example: a means of synchronizing the folding movement of the various steps so that they fold simultaneously.

In some embodiments: a moving stringer rotably mounted to the side of the steps opposite the axes, such that the structure, the steps, and the moving stringer form a parallel linkage mechanism.

In some embodiments: a series of linkages between adjacent steps, mechanically linking the motion of each step to the motion of the steps adjacent to it.

Widely varying other fold-coordinating means are possible.

8 DETAILED DESCRIPTION

The scope includes but is not limited to the embodiments described herein, and further includes various modifications and alternative forms as defined by the claims.

First Embodiment

FIGS. 4 through 8 show an embodiment with, for each step, two wedges which offset the axis orientation. Thus the inclination and azimuth are offset, as compared with the axes of the prior art shown in FIGS. 1, 2, and 3, which are not offset from either the tread or the traversal direction but rather are parallel both to the tread and to the traversal direction. One such wedge mounts the axis to the stringer, facilitating an azimuth offset (111) for this embodiment of (½) arcsin $$\left(\frac{\text{thickness}}{\text{run}}\right)$$

(~5.24°). The other such wedge mounts the axis to the step, and facilitates an inclination offset (110) of that same angle.

The selection of inclination offset, azimuth offset, and axis location for this embodiment lead to the following characteristics of its stowed state and folding trajectory: the step's leading edge is vertical in the stowed state, the steps in their stowed state have moved substantially from the traversal path (in this case to the overlaying stowed state shown in FIG. 5B, FIG. 6F, FIG. 7B, and FIG. 8F), and collision of adjacent steps is prevented throughout the folding trajectory.

For this and other embodiments, CAD software, or geometry and algebra, are methods which can determine exactly which axis orientations and locations facilitate rotation into a compact (or otherwise advantageous) stowed state without colliding with adjacent steps or other elements.

FIGS. 7 and 8 show the embodiment of FIGS. 4, 5, and 6, with the addition of a moving stringer rotably attached to each step via a second axis which is parallel to the first. The resulting apparatus forms a parallel-linkage mechanism such that the moving stringer serves as a means of coordinating the motion of the steps as they fold (fold-coordinating means). Some such mechanisms, like the one pictured in FIGS. 7 and 8, can also help to distribute load among steps and transfer load to the ground.

FIG. 6E and FIG. 8E show each of these variants folded from the deployed state by the critical angle of arccos $$\left(\frac{\text{thickness}}{\text{rise}}\right)$$

(~73.40° tor this embodiment). In the stowed state shown in FIG. 5B, FIG. 6F, FIG. 7B, and FIG. 8F, the steps have been rotated from the deployed state by ~90.48°.

Second Embodiment

FIGS. 9 through 12 show an embodiment similar to the first embodiment, except which uses a two-barrel hinge to facilitate the axial rotation. It's inclination offset is 6° and azimuth offset is also 6°.

FIGS. 11 and 12 show the embodiment of FIGS. 9 and 10 with the addition of a moving stringer forming a parallel-linkage mechanism and serving as a means of coordinating the steps' motion (fold-coordinating means).

FIG. 10E and FIG. 12E show each of these variants folded from the deployed state by the critical angle of arccos $$\left(\frac{\text{thickness}}{\text{rise}}\right)$$

(~73.40° for this embodiment). In the stowed state shown in FIG. 9B, FIG. 10F, FIG. 11B, and FIG. 12F, the steps have been rotated from the deployed state by 93°.

Third Embodiment

FIGS. 13 through 16 show an embodiment similar to the first and second embodiments, except which uses a mortise hinge to facilitate the axial rotation.

Like the first embodiment its azimuth offset is ~5.24° and inclination offset is also ~5.24°. But a difference it has from both the first and second embodiments is the location of each axis, which largely lies within the thickness of the step rather than being above the step. Like the first embodiment, the steps' leading edges are vertical in the stowed state.

FIGS. 15 and 16 show the embodiment of FIGS. 13 and 14 with the addition of a moving stringer forming a parallel-linkage mechanism and serving as a means of coordinating the steps' motion (fold-coordinating means).

FIG. 14E and FIG. 16E show each of these variants folded from the deployed state by the critical angle of arccos $$\left(\frac{\text{thickness}}{\text{rise}}\right)$$

(~73.40° for this embodiment). In the stowed state shown in FIG. 13B, FIG. 14F, FIG. 15B, and FIG. 16F, the steps have been rotated from the deployed state by ~90.48°.

Fourth Embodiment

FIGS. 17 through 20 show an embodiment similar to the third embodiment insofar as it uses a mortise hinge to facilitate the axial rotation. However, whereas the axes of the third embodiment have both inclination and azimuth offset, the axes of this fourth embodiment have azimuth offset but no inclination offset. That is, the axes are parallel to the (deployed) tread plane. For this fourth embodiment, the inclination offset is zero and the azimuth offset is ~12.51°.

The orientation of the axes for this embodiment facilitates a folding motion that moves the steps somewhat backward as they rotate upwards from deployed state to stowed state. In their stowed state, the steps' leading edges are not vertical, but tilted back[3] some, towards the traversal path's ascending direction.

[3]back as defined in the glossary

FIGS. 19 and 20 show the embodiment of FIGS. 17 and 18 with the addition of a moving stringer forming a parallel-linkage mechanism and serving as a means of coordinating the steps' motion (fold-coordinating means).

FIG. 18E and FIG. 20E show each of these variants folded from the deployed state by the critical angle of arccos $$\left(\frac{\text{thickness}}{\text{rise}}\right)$$

(~73.40° for this embodiment). In the stowed state shown in FIG. 17B, FIG. 18F, FIG. 19B, and FIG. 20F, the steps have been rotated from the deployed state by ~92.82°.

Fifth Embodiment

FIGS. 21 through 24 show an embodiment similar to the fourth embodiment, except instead of having azimuth offset and no inclination offset, it has inclination offset and no azimuth offset. That is, the axes are parallel to the traversal path. For this fifth embodiment, the azimuth offset is zero and the inclination offset is ~9.58°.

The orientation of the axes for this embodiment facilitates a folding motion that moves the steps somewhat forward as they rotate upwards from deployed state to stowed state. In their stowed state, the steps' leading edges are not vertical, but tilted forward[4] some (by an angle equal to the inclination offset), towards the traversal path's descending direction.

[4] forward as defined in the glossary

FIGS. 23 and 24 show the embodiment of FIGS. 21 and 22 with the addition of a moving stringer forming a parallel-linkage mechanism and serving as a means of coordinating the steps' motion (fold-coordinating means).

FIG. 22E and FIG. 24E show each of these variants folded from the deployed state by the critical angle of arccos $$\left(\frac{\text{thickness}}{\text{rise}}\right)$$

(~73.40° for this embodiment). In the stowed state shown in FIG. 21B, FIG. 22F, FIG. 23B, and FIG. 24F, the steps have been rotated from the deployed state by 90°.

Sixth Embodiment

FIGS. 25 through 28 show an embodiment in which the steps do not overlie each other in the stowed state; they lie flat along the stringer in their stowed state. This is despite the deployed state exhibiting tread overhang. The embodiment uses pivot bearings to facilitate the folding motion.

The axes of this embodiment have an inclination offset of ~16.24°, and an azimuth offset of ~−16.24°. These and the various other dimensions of the embodiment facilitate a folding trajectory for the steps which carries them from their deployed state and into the non-overlying, flat stowed state shown in FIG. 25B, FIG. 26F, FIG. 27B, and FIG. 28F. For an embodiment such as this one, CAD software or some geometry and algebra can be used to determine the maximum tread depth that permits folding into a flat stowed state without adjacent steps colliding, given the step shape and various other dimensions such as step thickness, rise, run, and the axes' orientations and locations. In the case of this embodiment, the tread depth exceeds the step run by ~17%.

FIGS. 27 and 28 show the embodiment of FIGS. 25 and 26 with the addition of a moving stringer forming a parallel-linkage mechanism and serving as a means of coordinating the steps' motion (fold-coordinating means).

FIG. 26E and FIG. 28E show each of these variants folded from the deployed state by the critical angle of arccos $$\left(\frac{\text{thickness}}{\text{rise}}\right)$$

(~73.40° for this embodiment). In the figures showing the stowed state, i.e. FIG. 25B, FIG. 26F, FIG. 27B, and FIG. 28F, the steps have been rotated from the deployed state by −94.48°.

Seventh Embodiment

FIGS. 29 through 32 show an embodiment whose axes orient the steps to fold largely forward along their trajectory from the deployed to the stowed state. It also has pivot bearings similar to those of the sixth embodiment.

To facilitate this forward rotation the embodiment's axes have an inclination offset of ~34.98°, and an azimuth offset of ~−27.30°. In the embodiment's stowed state, the steps' leading edges are angled up 30° from the horizontal.

FIGS. 31 and 32 show the embodiment of FIGS. 29 and 30 with the addition of a moving stringer forming a parallel-linkage mechanism and serving as a means of coordinating the steps' motion (fold-coordinating means).

FIG. 30E and FIG. 32E show each of these variants folded from the deployed state by the critical angle of arccos $$\left(\frac{\text{thickness}}{\text{rise}}\right)$$

(73.40' tor this embodiment). In the stowed state shown in FIG. 29B, FIG. 30F, FIG. 31B, and FIG. 32F, the steps have been rotated from the deployed state by ~100.30°.

Eighth Embodiment

FIGS. 33 through 36 show an embodiment whose structure is a well-like cylindrical wall. It also uses the two-barrel hinge of the second embodiment.

The inclination offset for each step in the embodiment is 6°, and the azimuth offset for each step is also 6°. Note that the traversal path direction changes for each step as the traversal path curves around the stairwell, and that the azimuth offset is relative to the local traversal path for that step.

FIGS. 35 and 36 show the embodiment of FIGS. 33 and 34 with the addition of a linkage mechanism between each pair of adjacent steps. Each linkage has 5 pivoting degrees of freedom, and its endpoints have been placed at carefully determined attachment points on the two steps it links, to facilitate the following: When a given step is in either the deployed or stowed state, the linkage ensures that its adjacent neighbors are in that same state. And, when the step rotates from one state to the other, the linkage rotates its adjacent steps similarly. Thus these linkage mechanisms collectively serve as a means of coordinating the steps' motion; folding one step will fold all other steps in the stair (fold-coordinating means).

FIG. 34E and FIG. 36E show each of these variants folded from the deployed state by the critical angle of arccos $$\left(\frac{\text{thickness}}{\text{rise}}\right)$$

(~73.40° for this embodiment). In the stowed state shown in FIG. 33B, FIG. 34F, FIG. 35B, and FIG. 36F, the steps have been rotated from the deployed state by 91°.

Ninth Embodiment

FIGS. 37 through 40 show an embodiment whose structure is an S-shaped curved wall. It also uses two-barrel hinges for its rotating axes.

For this embodiment, the inclination and offset angles vary throughout the stair. The bottom four steps have an inclination offset of 10° and an azimuth offset of 10°. The next three steps have an inclination offset of 6° and an azimuth offset of 6°. And the top step has no inclination offset nor azimuth offset. These inclination and azimuth offsets vary according to the changing curve of the wall throughout the traversal path, facilitating for each step a stowed state that is compact while accomodating the step above.

FIGS. 39 and 40 show the embodiment of FIGS. 37 and 38 with the addition of a linkage mechanism between each pair of adjacent steps. Just like the mechanisms of the eighth embodiment, these linkages collectively serve as a means of coordinating the steps' folding motion (fold-coordinating means).

FIG. 38E and FIG. 40E show each of these variants folded from the deployed state by the critical angle of arccos $$\left(\frac{\text{thickness}}{\text{rise}}\right)$$

(~73.40° for this embodiment). In the stowed state shown in FIG. 37B, FIG. 38F, FIG. 39B, and FIG. 40F, the steps have been rotated from the deployed state by 90°.

Tenth Embodiment

FIGS. 41 through 44 show an embodiment whose structure is a column, about which the traversal path spirals. The shown axis-mounted bearings facilitate the axial rotation.

As with the eighth and ninth embodiments, the traversal path direction changes throughout the stair. For each step, the inclination offset is 35°, and the azimuth offset is 55°.

FIGS. 43 and 44 show the embodiment of FIGS. 41 and 42 with the addition of a linkage mechanism between each pair of adjacent steps. As with the mechanisms of the eighth and ninth embodiments, these linkages collectively serve as a means of coordinating the steps' folding motion (fold-coordinating means).

FIG. 42D and FIG. 44D show each of these variants folded from the deployed state by the critical angle of arccos $$\left(\frac{\text{thickness}}{\text{rise}}\right)$$

(73.40° tor tins embodiment). In the stowed state shown in FIG. 41B, FIG. 42F, FIG. 43B, and FIG. 44F, the steps have been rotated from the deployed state by 113°.

9 CONCLUSION

Thus the reader will see that at least one embodiment provides several advantages by incorporating tread overhang and a simple folding mechanism. Tread overhang increases tread depth, providing increased safety and comfort, especially in space-constrained settings where step run is restricted. This advantage, common to fixed stairs, translates to folding stairs as well, making them safer and more comfortable to use. A simple folding mechanism guided by rotating axes offers convenience, durability, and space-saving effectiveness by allowing for smooth, controlled folding and reducing the overall profile of the stair. Meanwhile, fold-coordinating means further promote ease of folding and load distribution. These and other benefits offer a valuable improvement to the field of folding stairs.

While my above description contains many specificities, these should not be construed as limitations on the scope, but rather as an exemplification of several embodiments thereof. Many variations are possible. For example:

- Those incorporating gravity, a hook, latch, lock, fastener, catch, over-center mechanism, electromagnetic lock, or any other means of holding the stair in its stowed state.
- Those incorporating some other means of holding the steps in their deployed state, rather than just being pulled by gravity into it (as is the case in many of the embodiments described above).
- Those incorporating a railing, including folding or collapsible railings, and, further, those in which a railing's folding is synchronized with that of the steps.
- Those incorporating a spring, counterweight, or other energy-storage and actuation means of assisting the folding movement.
- Those for which only some of the steps implement the claims; embodiments that are part of a greater stair. For example: even if some of the steps do not have tread overhang or otherwise do not implement the claims, but some of the steps do implement the claims, then the stair as a whole still implements the claims.
- Those which fold in any direction. For instance: backward or down, instead of forward or up. Folding downward, for example, might be preferred if there were no floor directly below the stair, such as if there were a gap in the floor to accomodate another flight of stairs to the floor below. Folding backward, for example, might be preferred if there were a convenient space underneath the landing of the top step into which the steps could fold.
- Those incorporating any fold-coordinating means. Including, but not limited to: mechanical linkages such as joints, rods, gears, wheels, belts or chains, tensioning means such as cables or ropes, and electrical means such as electric actuators and electric control mechanisms.

Those whose fold-coordinating means does not coordinate the steps to fold simultaneously, but in some other coordinated way, for example, timed to occur in sequence.

Those whose folding motion is not coordinated by a fold-coordinating means, but in which each step must be folded individually, Those in which the parts are composed of any sufficiently capable material or combination thereof, including but not limited to wood, metal, plastic, resin, etc.

Those incorporating any means of facilitating axial rotation, including but not limited to hinges, bearings, magnetic bearings, surface-mount hinges, etc. This includes any means of rotating a step around a fixed axis line in 3d space, relative to the structure. There need not be a physical axle, pivot element, or even matter of any kind, positioned on the axis line about which the step rotates, only a means of facilitating rotation about that axis line.

Those whose structure is any means of fixing the axes at given orientations. For instance, a 'wall' or 'column' structure that is not vertical but slanted, or not curved nor straight but segmented.

Modular variants, for example single-step modules from which a stair of a desired length can be assembled.

Partial variants, for example just the axial component intended for later assembly with step and structure.

Those used for a mobile purpose, for example a ladder in which one stringer folds against the other in this manner to stow more compactly, or a step-stool that folds in this manner.

Those in which the folding carries the steps beyond a substantially-vertical plane. For example: to a sloped angle, or even by a half-rotation or more to the other side of the structure.

Winder stair variations, which can fold to either side of the turn.

Accordingly, the scope of the disclosure should be determined not by the embodiments illustrated, but by the appended claims and their legal equivalents.

What is claimed is:

1. A folding stair, comprising:

(a) a structure, (b) a sequence of steps, together forming a traversal path,
each with a substantially flat tread,
each with a thickness,
each with a width,
each with a depth,
each except the top step with a rise,
each except the top step with a run, (c) wherein for each step with a rise in said sequence, the step's width exceeds said rise, (d) wherein for each step with a run in said sequence, said step exhibits tread overhang, (e) for each step in said sequence, an axis rotably mounting said step to said structure, which guides the step's rotation between a deployed state, in which the steps of said sequence together form said traversal path, and a stowed state, (f) wherein each said axis is substantially to one side of its step, (g) wherein each said axis is to the same side of its step, (h) wherein for each step with a rise in said sequence, the orientation of said axis facilitates the angle of rotation between said deployed state and said stowed state to exceed the arccosine of the ratio whose denominator is the step's rise and whose numerator is the step above's thickness, whereby, said stair exhibits both foldability and tread overhang.

2. The folding stair of claim 1, further comprising a fold-coordinating means, which coordinates the folding motion between said deployed state and said stowed state, among the steps of said sequence.

3. A folding stair, comprising:

(a) a structure, (b) a sequence of steps, together forming a traversal path,
each with a substantially flat tread,
each with a thickness,
each with a width,
each with a depth,
each except the top step with a rise,
each except the top step with a run, (c) wherein for each step with a rise in said sequence, the step's width exceeds said rise, (d) wherein for each step with a run in said sequence, said step exhibits tread overhang, (e) for each step in said sequence, an axis rotably mounting said step to said structure, which guides the step's rotation between a deployed state, in which the steps of said sequence together form said traversal path, and a stowed state, (f) wherein the rotation from said deployed state to said stowed state substantially moves each step of said sequence from said traversal path, (g) wherein said stowed state of each step in said sequence is to the same side of said traversal path, (h) wherein for each step with a rise in said sequence, the orientation of said axis facilitates the angle of rotation between said deployed state and said stowed state to exceed the arccosine of the ratio whose denominator is the step's rise and whose numerator is the step above's thickness, whereby, said stair exhibits both foldability and tread overhang.

4. The folding stair of claim 3, further comprising a fold-coordinating means, which coordinates the folding motion between said deployed state and said stowed state, among the steps of said sequence.

5. A folding stair, comprising:

(a) a sequence of steps, together forming a traversal path,
each with a substantially flat tread,
each with a thickness,
each with a width,
each with a depth,
each except the top step with a rise,
each except the top step with a run, (b) wherein for each step with a rise in said sequence, the step's width exceeds said rise, (c) wherein for each step with a run in said sequence, said step exhibits tread overhang, (d) a structure to one side of said traversal path, (e) for each step in said sequence, an axis rotably mounting said step to said structure, which guides the step's rotation between a deployed state, in which the steps of said sequence together form said traversal path, and a stowed state, (f) wherein each said stowed state is to the same side of said traversal path as said structure, (g) wherein for each step with a rise in said sequence, the orientation of said axis facilitates the angle of rotation between said deployed state and said stowed state to exceed the arccosine of the ratio whose denominator is the step's rise and whose numerator is the step above's thickness, whereby, said stair exhibits both foldability and tread overhang.

6. The folding stair of claim 5, further comprising a fold-coordinating means, which coordinates the folding motion between said deployed state and said stowed state, among the steps of said sequence.

7. A folding stair, comprising:

(a) a structure, (b) a sequence of steps, together forming a traversal path,
each with a substantially flat tread,
each with a thickness,
each with a width,
each with a depth,
each except the top step with a rise,
each except the top step with a run, (c) wherein for each step with a rise in said sequence, the step's width exceeds said rise, (d) wherein for each step with a run in said sequence, said step exhibits tread overhang, (e) for each step in said sequence, an axis rotably mounting said step to said structure, which guides the step's rotation between a deployed state, in which the steps of said sequence together form said traversal path, and a stowed state, (f) wherein each said axis is substantially to one side of its step, (g) wherein each said axis is to the same side of its step, (h) wherein for each except the top step in said sequence, said axis is oriented either skew to said tread, or skew to the horizontal component of said traversal path, or both skew to said tread and skew to the horizontal component of said traversal path, whereby, said stair exhibits both foldability and tread overhang.

8. The folding stair of claim 7, further comprising a fold-coordinating means, which coordinates the folding motion between said deployed state and said stowed state, among the steps of said sequence.

9. A folding stair, comprising:

(a) a structure, (b) a sequence of steps, together forming a traversal path,
each with a substantially flat tread,
each with a thickness,
each with a width,
each with a depth,
each except the top step with a rise,
each except the top step with a run, (c) wherein for each step with a rise in said sequence, the step's width exceeds said rise, (d) wherein for each step with a run in said sequence, said step exhibits tread overhang, (e) for each step in said sequence, an axis rotably mounting said step to said structure, which guides the step's rotation between a deployed state, in which the steps of said sequence together form said traversal path, and a stowed state, (f) wherein the rotation from said deployed state to said stowed state substantially moves each step of said sequence from said traversal path, (g) wherein said stowed state of each step in said sequence is to the same side of said traversal path, (h) wherein for each except the top step in said sequence, said axis is oriented either skew to said tread, or skew to the horizontal component of said traversal path, or both skew to said tread and skew to the horizontal component of said traversal path, whereby, said stair exhibits both foldability and tread overhang.

10. The folding stair of claim 9, further comprising a fold-coordinating means, which coordinates the folding motion between said deployed state and said stowed state, among the steps of said sequence.

11. A folding stair, comprising:

(a) a sequence of steps, together forming a traversal path,
each with a substantially flat tread,
each with a thickness,
each with a width,
each with a depth,
each except the top step with a rise,
each except the top step with a run, (b) wherein for each step with a rise in said sequence, the step's width exceeds said rise, (c) wherein for each step with a run in said sequence, said step exhibits tread overhang, (d) a structure to one side of said traversal path, (e) for each step in said sequence, an axis rotably mounting said step to said structure, which guides the step's rotation between a deployed state, in which the steps of said sequence together form said traversal path, and a stowed state, (f) wherein each said stowed state is to the same side of said traversal path as said structure, (g) wherein for each except the top step in said sequence, said axis is oriented either skew to said tread, or skew to the horizontal component of said traversal path, or both skew to said tread and skew to the horizontal component of said traversal path, whereby, said stair exhibits both foldability and tread overhang.

12. The folding stair of claim 11, further comprising a fold-coordinating means, which coordinates the folding motion between said deployed state and said stowed state, among the steps of said sequence.

13. A folding stair, comprising:

(a) a structure, (b) a sequence of steps, together forming a traversal path,
each with a substantially flat tread,
each with a thickness,
each with a width,
each with a depth,
each except the top step with a rise,
each except the top step with a run, (c) wherein for each step with a rise in said sequence, the step's width exceeds said rise, (d) wherein for each step with a run in said sequence, said step exhibits tread overhang, (e) for each step in said sequence, an axis rotably mounting said step to said structure, which guides the step's rotation between a deployed state, in which the steps of said sequence together form said traversal path, and a stowed state, (f) wherein each said axis is substantially to one side of its step, (g) wherein each said axis is to the same side of its step, (h) wherein for each step with a rise in said sequence, the orientation of said axis facilitates the angle of rotation between said deployed state and said stowed state to exceed the arccosine of the ratio whose denominator is the step's rise and whose numerator is the step above's thickness, (i) wherein for each except the top step in said sequence, said axis is oriented either skew to said tread, or skew to the horizontal component of said traversal path, or both skew to said tread and skew to the horizontal component of said traversal path, whereby, said stair exhibits both foldability and tread overhang.

14. The folding stair of claim 13, further comprising a fold-coordinating means, which coordinates the folding motion between said deployed state and said stowed state, among the steps of said sequence.

15. A folding stair, comprising:

(a) a structure, (b) a sequence of steps, together forming a traversal path,
each with a substantially flat tread,
each with a thickness,
each with a width,
each with a depth,
each except the top step with a rise,
each except the top step with a run, (c) wherein for each step with a rise in said sequence, the step's width exceeds said rise, (d) wherein for each step with a run in said sequence, said step exhibits tread overhang, (e) for each step in said sequence, an axis rotably mounting said step to said structure, which guides the step's rotation between a deployed state, in which the steps of said sequence together form said traversal path, and a stowed state, (f) wherein the rotation from said deployed state to said stowed state substantially moves each step of said sequence from said traversal path, (g) wherein said stowed state of each step in said sequence is to the same side of said traversal path, (h) wherein for each step with a rise in said sequence, the orientation of said axis facilitates the angle of rotation between said deployed state and said stowed state to exceed the arccosine of the ratio whose denominator is the step's rise and whose numerator is the step above's thickness, (i) wherein for each except the top step in said sequence, said axis is oriented either skew to said tread, or skew to the horizontal component of said traversal path, or both skew to said tread and skew to the horizontal component of said traversal path, whereby, said stair exhibits both foldability and tread overhang.

16. The folding stair of claim 15, further comprising a fold-coordinating means, which coordinates the folding motion between said deployed state and said stowed state, among the steps of said sequence.

17. A folding stair, comprising:

(a) a sequence of steps, together forming a traversal path,
each with a substantially flat tread,
each with a thickness,
each with a width,
each with a depth,
each except the top step with a rise,
each except the top step with a run, (b) wherein for each step with a rise in said sequence, the step's width exceeds said rise, (c) wherein for each step with a run in said sequence, said step exhibits tread overhang, (d) a structure to one side of said traversal path, (e) for each step in said sequence, an axis rotably mounting said step to said structure, which guides the step's rotation between a deployed state, in which the steps of said sequence together form said traversal path, and a stowed state, (f) wherein each said stowed state is to the same side of said traversal path as said structure, (g) wherein for each step with a rise in said sequence, the orientation of said axis facilitates the angle of rotation between said deployed state and said stowed state to exceed the arccosine of the ratio whose denominator is the step's rise and whose numerator is the step above's thickness, (h) wherein for each except the top step in said sequence, said axis is oriented either skew to said tread, or skew to the horizontal component of said traversal path, or both skew to said tread and skew to the horizontal component of said traversal path, whereby, said stair exhibits both foldability and tread overhang.

18. The folding stair of claim 17, further comprising a fold-coordinating means, which coordinates the folding motion between said deployed state and said stowed state, among the steps of said sequence.

* * * * *